US009587363B2

(12) United States Patent
Pedraza

(10) Patent No.: US 9,587,363 B2
(45) Date of Patent: Mar. 7, 2017

(54) STATIONARY, PRE-FABRICATED ANCHOR HAVING AN ANCHOR BLOCK AND AN ANCHOR ROD

(71) Applicant: Oscar Pedraza, Sugar Land, TX (US)

(72) Inventor: Oscar Pedraza, Sugar Land, TX (US)

( * ) Notice: Subject to any disclaimer, the term of this patent is extended or adjusted under 35 U.S.C. 154(b) by 0 days.

(21) Appl. No.: 14/096,342

(22) Filed: Dec. 4, 2013

(65) Prior Publication Data

US 2014/0090314 A1 Apr. 3, 2014

Related U.S. Application Data

(63) Continuation-in-part of application No. 13/290,281, filed on Nov. 7, 2011, now abandoned.

(51) Int. Cl.
*E02D 5/80* (2006.01)
*E02D 27/42* (2006.01)

(52) U.S. Cl.
CPC ..... *E02D 5/80* (2013.01); *E02D 5/803* (2013.01); *E02D 27/42* (2013.01)

(58) Field of Classification Search
CPC ..... E04G 21/142; E04G 15/04; E04G 21/185; B66C 1/666; B66C 1/66; B28B 23/005; B28B 23/0056; E02D 5/80; E02D 27/42; E02D 5/803; E02D 5/74; E02D 27/00; E04B 1/41; E04B 1/34347; E04B 2002/0243; F03D 11/045
USPC ..... 52/122.1, 123.1, 124.1, 124.2, 52/125.1–125.6, 155, 156, 159, 160, 52/162–166, 378, 575, 698–701, 703, 52/704, 706–711
See application file for complete search history.

(56) References Cited

U.S. PATENT DOCUMENTS

| | | | | | |
|---|---|---|---|---|---|
| 741,043 | A | * | 10/1903 | Kann | 52/513 |
| 787,787 | A | * | 4/1905 | Peabody | 52/125.3 |
| 957,823 | A | * | 5/1910 | Viles | F16G 11/12 135/120.4 |
| 1,386,509 | A | * | 8/1921 | Kirmes et al. | 52/710 |
| 1,529,317 | A | * | 3/1925 | Ludeman | 52/125.3 |
| 2,032,030 | A | * | 2/1936 | Talen | 52/166 |
| 2,344,206 | A | * | 3/1944 | Forni | 264/278 |
| 3,652,118 | A | * | 3/1972 | Goldberg | 294/89 |
| 3,890,751 | A | * | 6/1975 | Caputo et al. | 52/166 |
| 4,193,241 | A | * | 3/1980 | Jensen et al. | 52/405.4 |
| 4,437,272 | A | * | 3/1984 | Johnson | E04B 1/3538 52/125.1 |
| 4,599,839 | A | * | 7/1986 | Jacov | 52/309.12 |
| 4,671,554 | A | * | 6/1987 | Lancelot | B66C 1/666 294/82.24 |

(Continued)

OTHER PUBLICATIONS

PCT/US2014/068535 International Search Report and Written Opinion dated Feb. 24, 2015 (12 p.).

*Primary Examiner* — Phi A
*Assistant Examiner* — Omar Hijaz
(74) *Attorney, Agent, or Firm* — Conley Rose, P.C.

(57) ABSTRACT

An anchor for stabilizing an object includes an anchor block having a body portion, a pair of wing portions extending from the body portion, and a coupling-channel located in the body portion. The coupling-channel is configured to couple the anchor block to an anchor rod. The anchor block is generally trapezoidal in a view. The wing portions include a first plurality of sloping ribs extending from body portion and a plurality of recesses disposed between the sloping ribs.

22 Claims, 16 Drawing Sheets

(56) References Cited

U.S. PATENT DOCUMENTS

| | | | | |
|---|---|---|---|---|
| 4,881,715 | A * | 11/1989 | Von Holdt | 249/165 |
| 5,750,894 | A * | 5/1998 | Russell et al. | 73/581 |
| 5,819,483 | A * | 10/1998 | Wells | 52/166 |
| 5,833,400 | A * | 11/1998 | Wamsher | 405/244 |
| 6,341,452 | B1 * | 1/2002 | Bollinghaus | 52/125.5 |
| 6,453,625 | B1 * | 9/2002 | Corbett | 52/125.3 |
| 6,557,818 | B2 * | 5/2003 | Manthci | 249/171 |
| 6,647,674 | B1 * | 11/2003 | Lancelot, III | E04G 21/142 294/82.17 |
| 6,866,449 | B2 * | 3/2005 | Riddiough | E21B 41/0021 114/293 |
| 7,765,764 | B2 * | 8/2010 | Zambelli et al. | 52/702 |
| 7,827,741 | B2 * | 11/2010 | Davies et al. | 52/151 |
| 2002/0083658 | A1 * | 7/2002 | Dial, Jr. | 52/125.4 |
| 2007/0186489 | A1 * | 8/2007 | Osbon | E04H 9/14 52/23 |
| 2011/0061321 | A1 * | 3/2011 | Phuly | F03D 11/045 52/297 |
| 2011/0283929 | A1 * | 11/2011 | Hardison | 114/230.26 |
| 2012/0005970 | A1 * | 1/2012 | Reyes et al. | 52/146 |
| 2013/0111829 | A1 | 5/2013 | Pedraza | |

* cited by examiner

STATIONARY, PRE-FABRICATED ANCHOR HAVING AN ANCHOR BLOCK AND AN ANCHOR ROD

CROSS-REFERENCE TO RELATED APPLICATIONS

This application is a continuation-in-part under 35 U.S.C. §120 of U.S. patent application Ser. No. 13/290,281 filed Nov. 7, 2011 and entitled "Pre-Fabricated Anchor Block and Rotatable Anchor Rod," which is hereby incorporated herein by reference in its entirety.

STATEMENT REGARDING FEDERALLY SPONSORED RESEARCH OR DEVELOPMENT

Not applicable.

BACKGROUND

Wind, flood water, and seismic activity are among the natural forces that act to rearrange objects. Man-made structures therefore are commonly designed to compensate or to limit the tendency of nature to move and to bend the objects. Vertically elongate structures such as communication towers, other antennas, electrical transmission towers, oil derricks, and offshore oil platforms are examples of structures that need protection against unwanted movement and sway.

BRIEF SUMMARY OF THE DISCLOSURE

These and other needs in the art are addressed in one embodiment by an anchor for stabilizing an object. In an embodiment, the anchor includes an anchor block having a body portion, a pair of wing portions extending from the body portion, and a coupling-channel disposed in the body portion. The coupling-channel is configured to couple the anchor block to an anchor rod. The anchor block is generally trapezoidal in a view, for example in an end view or in a side view. The wing portions include a first plurality of sloping ribs extending from body portion and a plurality of recesses disposed between the sloping ribs.

In another embodiment, an anchor includes an anchor block having a base portion extending in a lateral direction from a first side to a second side and extending in a perpendicular direction from a first end to a second end. The anchor block also includes a body portion coupled to the base portion and disposed between the ends. The body portion extends in a direction away from the base portion. The anchor block further includes a through-channel extending entirely through the base portion and the body portion and configured to couple the anchor block to an anchor rod assembly, and includes a plurality of ribs coupled to the body portion and the base portion and extending along the base portion.

In still another embodiment, an anchor includes an anchor block having a first outer surface and a multi-facetted locking channel extending though the first outer surface. The multi-facetted locking channel is configured to receive and capture an anchor rod, and the multi-facetted locking channel comprises a T-shaped opening through the first outer surface, and a J-shaped channel portion intersecting the T-shaped opening. The J-shaped channel portion includes a first portion extending in a first direction from the first outer surface into the anchor block and a second portion extending in a second direction toward the first outer surface. At least some part of the second portion of the J-shaped channel portion does not extend to the first outer surface.

These and other needs in the art are addressed by a method for installing an anchor assembly. The method includes: receiving a pre-fabricated anchor block at an installation site, and coupling an anchor rod to the pre-fabricated anchor block; wherein, the rod remains rotatable with respect to the anchor block. The method further includes installing the pre-fabricated anchor block at the installation site.

Thus, embodiments described herein comprise a combination of features and advantages intended to address various shortcomings associated with certain prior devices, systems, and methods. The various characteristics described above, as well as other features, will be readily apparent to a person having ordinary skill in the art upon reading the following detailed description, and by referring to the accompanying drawings.

BRIEF DESCRIPTION OF THE DRAWINGS

For a detailed description of the disclosed embodiment(s), reference will now be made to the accompanying drawings in which.

DETAILED DESCRIPTION OF THE DISCLOSED EMBODIMENTS

Figure 1:
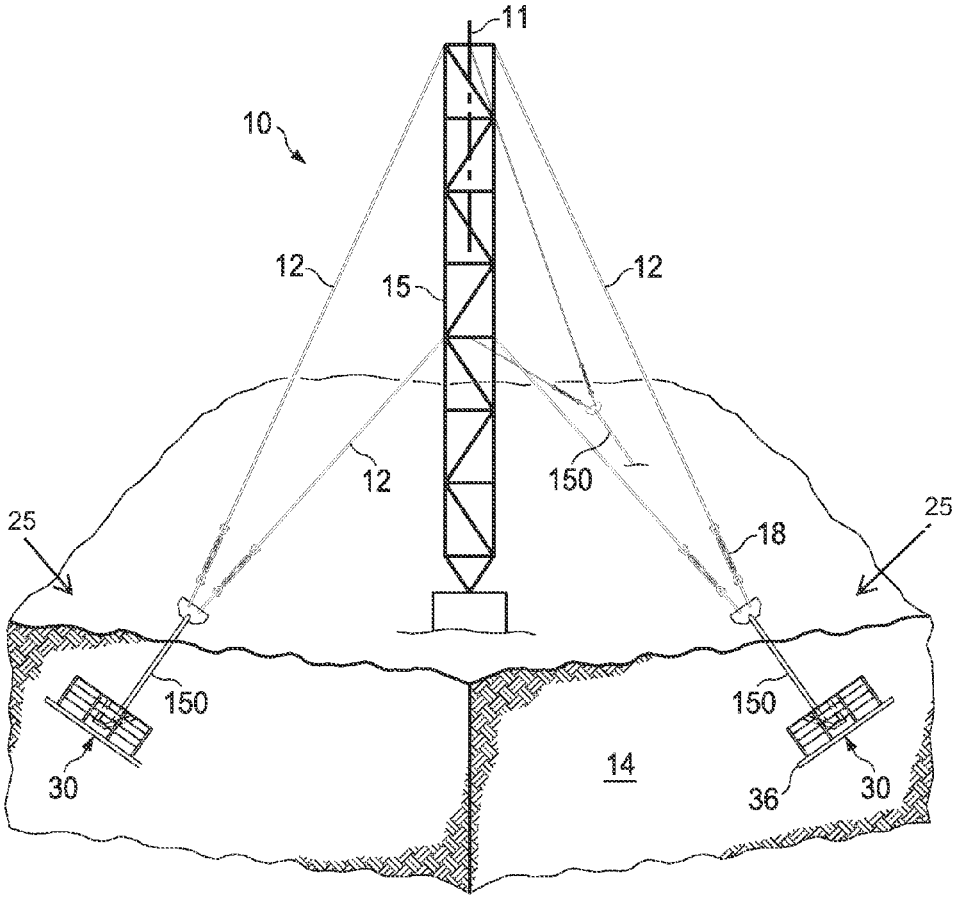
FIG. 1 is a perspective view of a tower anchored in accordance with the principles disclosed herein.

The following discussion is directed to various embodiments. The embodiments disclosed should not be interpreted or otherwise used as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used in the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness. In addition, like or identical reference numerals may be used to identify common or similar elements.

In this disclosure and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples or is coupled to a second device, that connection may be through a direct connection, or through an indirect connection via other devices, components, and connections. In addition, as used herein, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to the axis, and a radial distance means a distance measured perpendicular to the axis.

In this disclosure and in the claims, any reference to a relative direction or relative position in the description and the claims will be made for purposes of ease of description or clarification, with examples including "top," "bottom," "up," "upward," "left," "leftward," "down," "lower," "clock-wise," "front," "back," and the like. For example, a relative direction or a relative position of an object or feature pertains to the orientation as shown in a figure or as described. If the object or were viewed from another orientation, it may be appropriate to described the direction or position using an alternate term.

Furthermore, in this disclosure and in the claims, the following definitions will be used:

Both terms "Guy wires" or, equivalently, "guy cables" refer to wires, cables, ropes, or other suitable flexible members that may be used to couple a tower or another object to a stationary anchoring location. Guy wires or guy cables may also be written as guy-wires or guy-cables.

"J-shape" [noun] and "J-shaped" [adjective] describe an object or a space created by one or more features, wherein the object or space appears, in some fashion, to have a general shape or form similar to a capital letter "J," which may be best seen in a san serif font, that is to say without any cross-member at the top.

"Lateral" means relating to or located at a side, for example extending towards or from what is defined to be a left side or extending towards or from what is defined to be a right side, being generally parallel to a front end or front edge or generally parallel to or a back end or back edge.

"Transverse" means perpendicular to a lateral direction, for example extending towards or from a front end or towards or from a back end, being generally parallel to a left side or left edge or generally parallel to or a right end or right edge.

"T-shape" [noun] and "T-shaped" [adjective] describe an object or a space created by one or more features, wherein the object or space appears, in some fashion, to have a general shape or form similar to a capital letter "T" or similar to a lower case letter "t."

"Tower" means any vertically elongated structure that may be anchored or tethered to the earth and thus may benefit from this disclosure. Towers include, for example, various antenna, observation towers, electrical transmission poles, and electrical transmission towers.

When considering other applications of the disclosed technology, the term "another structure," "object to be stabilized," or "object" may refer to any of the following: a building, a pre-manufactured building, a restraining wall, equipment (including air conditioning units, compressors, and power generators), an advertising sign, a tent, an oil derrick, an offshore oil platform, a light pole, a power pole, a balloon, and the like.

The disclosure relates generally to equipment and methods for anchoring structures or objects against wind and other natural forces that may act to move or to bend the structures. More particularly, the disclosure relates to an anchoring systems and methods that may be applied, for example, to hold the guy cables of elongate communication towers or electrical transmission towers.

Figure 2:
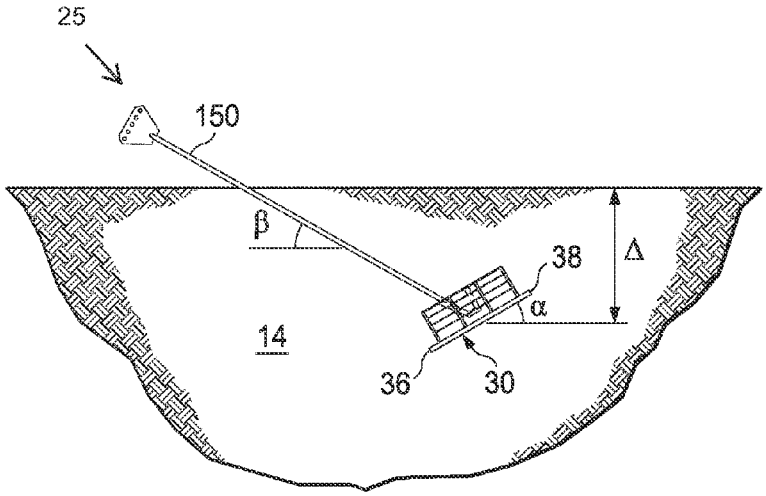
FIG. 2 is an elevation view of an anchor assembly having a pre-fabricated anchor block and a rotatable, removable anchor rod embedded in the earth in accordance with the principles disclosed herein.

FIG. 1 introduces an anchored tower 10, which in the disclosed example, is illustrated as a communications tower. Tower 10 comprises at least one mast 15, at least one pre-fabricated anchor block 30, at least one rotatable, removable anchor rod 150, and at least one diagonally-extending guy cable 12. Anchor rod 150 may also be called an anchor linkage or an anchor rod assembly. A centerline 11 defines the vertical centerline of the tower 10 structure. Guy cable 12 may be a single, contiguous cable or may be formed from a plurality of cable segments coupled by electrical insulators or other material. Mast 15 is coupled to one end of at least one guy cable 12, while the other end of the guy cable 12 is coupled to a rotatable, removable anchor rod 150 and pre-fabricated anchor block 30 embedded in the earth 14. Each anchor block 30 is buried at a horizontal distance from mast 15. A turnbuckle 18 may be positioned between each guy cable 12 and anchor rod 150. In some situations, like the one shown in FIG. 1, a plurality of guy cables 12 will couple to a particular rod 150 and block 30. The example of FIG. 1 has three anchor rods 150 and three pre-fabricated anchor blocks 30 coupled to mast 15 by a plurality of guy cables 12. In general a tower or a mast may couple any number of anchor blocks and anchor rods. In at least one embodiment tower 10 further comprises a system or method to reduce corrosion in any or all of its components. Like tower 10, another structure may be coupled, anchored, or tethered to the earth by a rod 150 and an anchor block 30. A closer view of a pre-fabricated anchor block 30 coupled with a rotatable, removable anchor rod 150 is shown in FIG. 2. In one embodiment, an anchor assembly 25 includes the combination of pre-fabricated anchor block 30 and rod 150. Anchor assembly 25 will also be called anchor 25.

Figure 3:
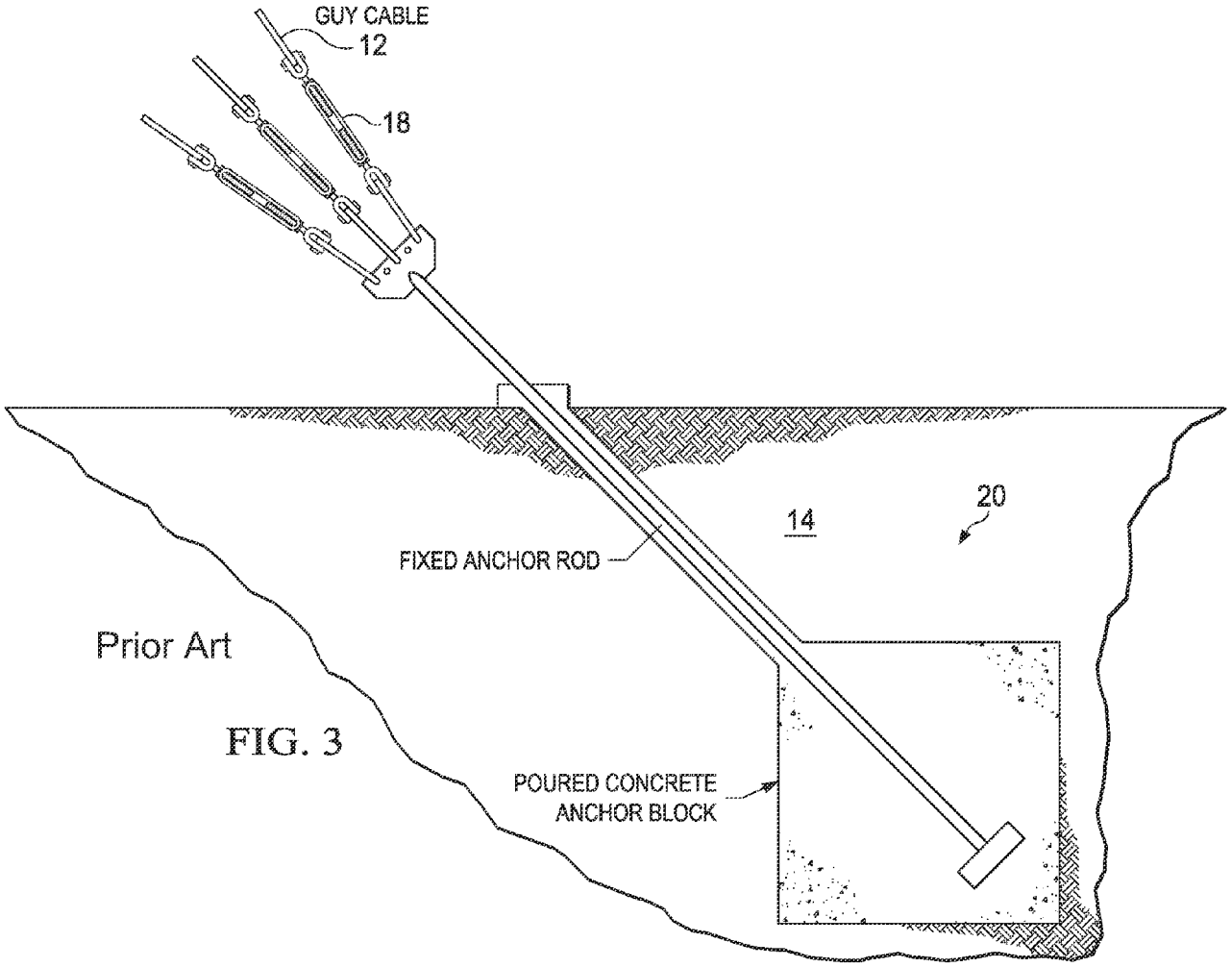
Prior Art FIG. 3
FIG. 3 is an elevation view of a poured anchor block and anchor rod combination.

Alternatively, FIG. 3 shows an example of a conventional, poured-in-place anchor block and rod 20, which comprises at least one fixed, rigid anchor rod integrally coupled to and partially embedded within a poured cement or concrete anchor block. The block and the lower portion of the rod are buried in the earth. The rod extends diagonally toward the tower and couples to the guy cables. For relatively newer anchors, the entire buried portion of the rod may be encased in cement or concrete to inhibit (i.e. "to reduce the rate of") corrosion. Therefore, although, not shown in FIG. 1, another tower or another structure that benefits from the disclosure herein is coupled to a rotatable, removable anchor rod 150 and a pre-fabricated anchor block 30, while the same tower or structure is coupled to one or more poured-in-place anchor block and rod 20. However, the installation of a new or replacement block and rod 20 may be costly and may extend over multiple days. On one or more days, the site is excavated and forms and reinforcing are installed for the cement. The block and the anchor rod encasement are poured with fixed anchor rods installed and partially protruding. The new poured anchor is allowed to cure or "to set." On a later day, a crew returns to attach the guy cables to the anchor rod. If the direction of the force exerted by guy cables after coupling differs from the design, or if the direction of the force changes with time, added stress may be placed on the rod and its corrosion-inhibiting coating, such as a galvanized coating. Such are the complications of using a poured anchor block 20 to hold a structure like tower 10.

Figure 4:
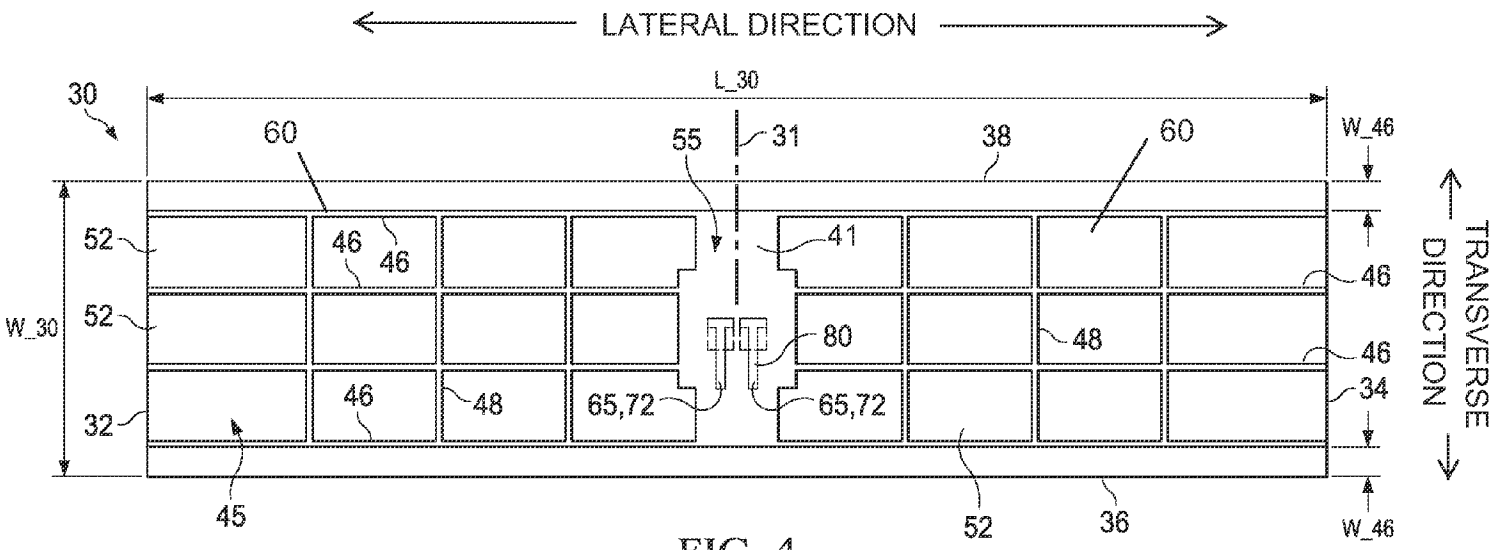
FIG. 4 is an top view of a the pre-fabricated anchor block shown in FIG. 2.

For one embodiment, FIG. 4 shows the top view of a generally rectangular pre-fabricated anchor block 30. Seen in FIG. 5, the front end profile of anchor block 30 is generally trapezoidal with an upper surface 41 generally parallel to a lower surface 42. Anchor block 30 comprises a transverse center line 31, a first or left side 32, a second or right side 34, a first or front end 36, a second or back end 38, a base portion or base plate 45, a plurality of lateral structural ribs 46, a plurality of transverse structural ribs 48, a body portion 55 couple to base portion 45, and at least one multi-facetted locking channel 65. The structural ribs 46, 48 couple to base portion 45 or to body portion 55. Base portion 45 extends laterally from left side 32 to right side 34 and extends in a perpendicular, i.e. transverse, direction from first end 36 to second end 38. The outermost dimensions of anchor block 30 are a lateral length of L_30, transverse width of W_30, and a height of H_30. In the example shown, anchor block 30 has eight lateral ribs 46, six transverse ribs 48, and two multi-facetted locking channels 65; however, other embodiments may have fewer or more of these features 46, 48, 65. In the example of FIG. 4, body portion 55 is symmetrically positioned about center line 31 and will also be called central block 55. The ribs 46 and 48 may be positioned on either side or both sides of central block 55. Upper surface 41 and lower surface 42 are examples of outer surfaces of anchor block 30.

Figure 5:
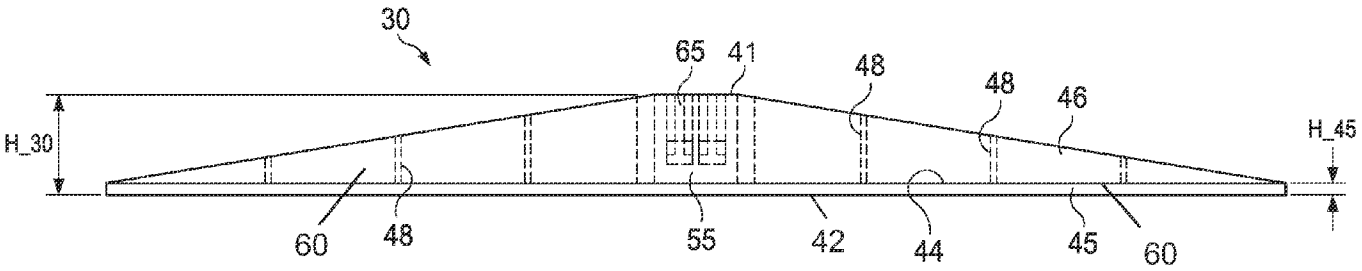
FIG. 5 is an front view of the pre-fabricated anchor block of FIG. 2.
Figure 6:
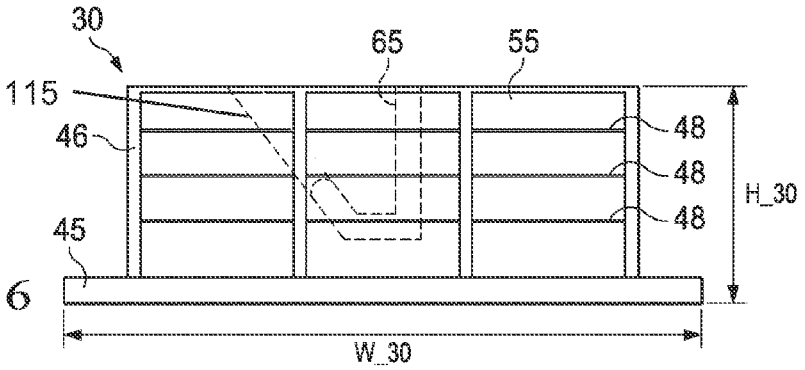
FIG. 6 is an side view of the pre-fabricated anchor block of FIG. 2.

Continuing to reference FIG. 4 and FIG. 5, base portion 45 is a generally rectangular block, comprising a thickness H_45. Central block 55 comprises a lateral length that may be smaller than L_30 and a transverse width that may be smaller than W_30. Central block couples (e.g. is affixed to or integral with) base the middle of plate 45 and extends in a direction away from the base portion 45. The combined height of base portion 45 and central block 55 corresponds to the height H_30. Central block 55 shares at least a portion of upper surface 41 with anchor block 30. A portion of the lateral ribs 46 extend from central block 55 to left side 32. A preferably equal portion of the lateral ribs 46 extend from the central block 55 to the right side 34. The outermost lateral ribs 46 are inset away from front end 36 and back end 38 by an edge offset of W_46. Transverse ribs 48 extend across lateral ribs 46 and are coupled with them, forming ninety degree angles at each intersection of a lateral rib 46 and a transverse ribs 48, which is as best seen in FIG. 4. In other embodiments, at least some of the ribs 46, 48 may intersect to form angles that are not ninety degrees. In the example of FIG. 5, the height of lateral ribs 46 tapers or slopes from central block 55 down to a nearly zero height near the sides 32, 34. Correspondingly, the heights of transverse ribs 48 are reduced for those ribs 48 closer to sides 32, 34. The differing heights of the transverse ribs 48 can also be seen in FIG. 6. A plurality of empty recesses 52 are positioned between the ribs 46, 48.

Anchor block 30 can be described as having a pair of wing portions 60 extending from either side of the body portion 55. The wing portions may be defined to include any of: the sloping ribs 46 that extend laterally from body portion 55, the lateral ribs 48, the base portion 45, and the recesses 52 disposed between the ribs 46.

Figure 7:
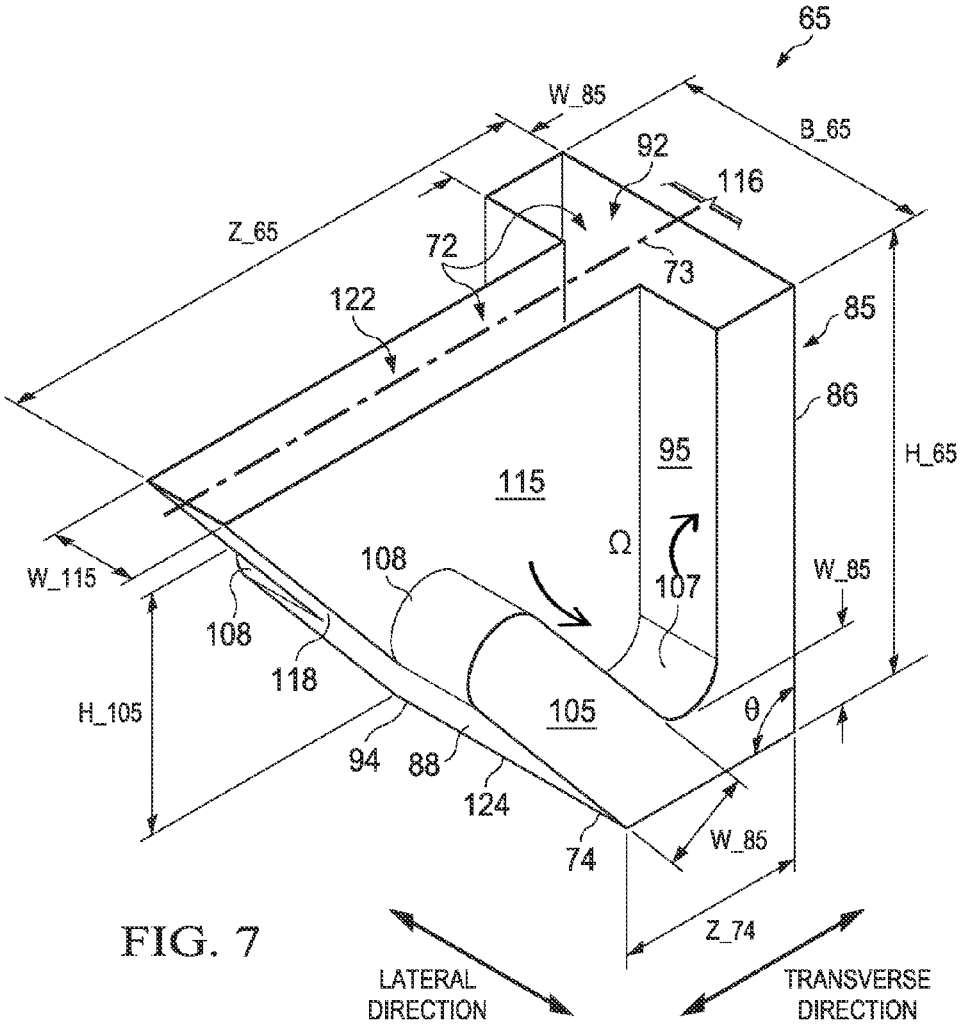
FIG. 7 is an isometric view of the locking channel of the pre-fabricated anchor block of FIG. 4.

As shown in the example of FIG. 4, each of the two multi-facetted locking channels 65 includes a T-shaped opening 72 extending through upper surface 41 and into central block 55. The voids formed by locking channel 65 are indicated by hidden lines (that is to say: dashed lines) in the top, front, and side views of FIG. 4, FIG. 5, and FIG. 6. However, a more complete view of the shape of locking channel 65 is presented in FIG. 7, where T-shaped opening 72 is clearly distinguishable. T-shaped opening 72 may be explained as a combination of a first rectangular opening 122 disposed perpendicular to and connected to the middle of a second rectangular opening 92. The other surfaces (or equivalently "other facets") seen in FIG. 7 represent the interfacial boundaries between the voids of locking channel 65 and the remaining solid material of the block in which channel 65 is formed. In the disclosed embodiment, channel 65 is formed in central block 55. T-shaped opening 72 is generally symmetric about a transverse centerline 73.

FIG. 7 show that each multi-facetted locking channel 65 further comprises a base 74, a J-shaped portion 85, and a mid-portion portion 115. Due to the inclusion of portions 72, 85, 115 or any two or more similar portions having similar form or function, locking channel 65 may also be described as a channel with multiple portions or multiple sections. Locking channel 65 is characterized by a height H_65, a lateral breadth B_65, and a transverse depth Z_65. Height H_65 is less than anchor block height H_30. Height H_65 may be less than the difference between height H_30 and base height H_45 so that locking channel 65 does not extend into base portion 45. Breadth B_65 is less than length L_30 and less than the lateral length of central block 55. Depth Z_65 is less than width W_30 and less than the transverse width of central block 55.

Continuing with FIG. 7, J-shaped portion 85 comprises a back end 86, a front end 88, a top opening 92, a base 94, a first portion or long arm 95, a second portion or short arm 105, a lateral breadth of B_65, and a width W_85. Top opening 92 is coplanar with upper surface 41 and corresponds to the cross-member portion of T-shaped opening 72. Back end 86 and long arm 95 intersect and extend into anchor block 30 from upper surface 41. At the base of long arm 95, back end 86 and base 94 intersect forming an angle θ (theta). Thus, the angle θ describes the orientation of back end 86 and long arm 95 with respect to base 94. In the disclosed embodiment θ (theta) is approximately ninety degrees. However, arm 95 may instead slope laterally forward, causing θ (theta) to be less than 90 degrees, or arm 95 may slope laterally backward, causing θ (theta) to be greater than 90 degrees. A curved or filleted section 107 connects short arm 105 to long arm 95 in the vicinity of base 94. Short arm 105 slopes diagonally upward, away from long arm 95 and rises a height of H_105 from base 94. Height H_105 is less than height H_65 so short arm 105 does not extend to upper surface 41 of central block 55. Short arm 105 is disposed at an angle Ω (omega) with respect to long arm 95. In the example, the angle Ω (omega) has a value greater than zero degrees and less than 90 degrees. The upper end 108 of short arm 105 may be, for example, rounded with a radius of curvature equal to half the width W_85. In at least one embodiment, the upper end 108 is generally flat, possibly parallel to top opening 92. Base 94 generally defines a majority or all of base 74 of locking channel 65, spanning a lateral breadth of B_65 and a transverse depth Z_74. Base 94 is shown to be generally flat and horizontal, but may be curved upward or downward in the transverse direction, that is to say, in a direction that may extend generally from front end 36 to the back end 38 of anchor block 30. Preferably for a channel 65 embedded within block 30, short arm 105 is positioned closer to front end 36 than is long arm 95. As stated earlier, the J-shaped portion 85, which includes long arm 95, section 107, short arm 105, and upper end 108, extends through the lateral breadth of B_65.

The J-shaped portion 85 of channel 65 may be explained as a combination of facets and features in central block 55 that form a first generally rectangular void, called long arm 95, the bottom of which is connected to a curved or filleted void section 107, which is also connected to a second generally rectangular void, called short arm 105. Any of these sections 95, 107, or 105 may have more or possibly less curvature than depicted in FIG. 7. It is possible that long arm 95 be directly connected to short arm 105 with no curved or filleted section 107 between arms 95, 105. In other embodiments with a longer transverse depth Z_74, section 107 may be longer.

In the example locking channel 65 of FIG. 7, the generally mid-portion 115 is superimposed through, i.e. intersects, the center of J-shaped portion 85, sharing at least one or more common surfaces or one or more common volumes (voids). As shown in the side view of FIG. 6 for this embodiment, mid-portion portion 115 has a trapezoidal shape and therefore may also be called a trapezoidal portion. Mid-portion 115 comprises a back end 116, a front end 118, a top opening 122, a base 124, and a width W_115. In at least one embodiment, top opening 122 is parallel to base 124. In at least one embodiment width W_115 is equal to width W_85. Top opening 122 corresponds to the "leg" portion of T-shaped opening 72 and also extends straight through the cross-member of opening 72, which is equivalent to top opening 92. Therefore top opening 122 overlaps (extends into or through) a region of top opening 92. In the example shown, back end 116 overlaps a region of back end 86, the lower region of front end 118 overlaps a region of front end 88, and base 124 overlaps a region of base 94. However, in at least one embodiment, the front end 118 extends laterally beyond front end 88, and back end 116 extends laterally beyond back end 86. Other derivations are possible.

Figure 8:
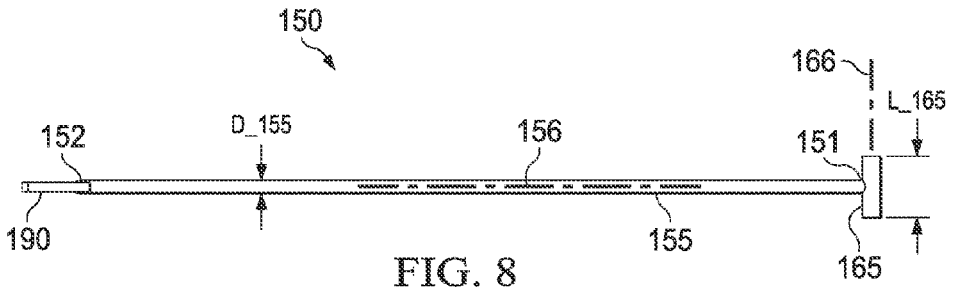
FIG. 8 is top view of an embodiment of a rotatable, removable anchor rod in accordance with the principles disclosed herein.
Figure 9:
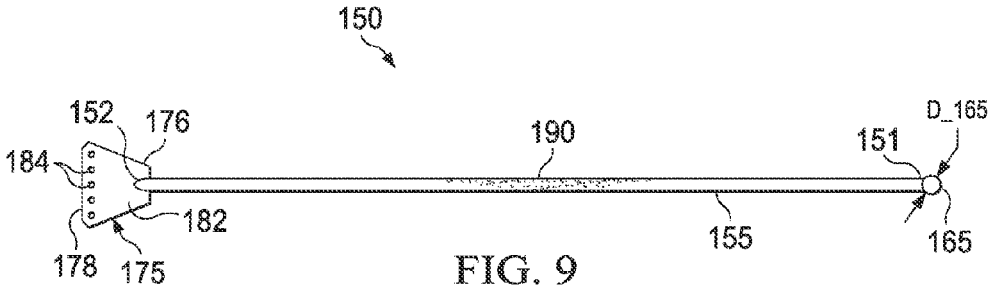
FIG. 9 is an side view of the anchor rod of FIG. 8.

FIG. 1 and FIG. 2 illustrate that a rotatable, removable anchor rod 150 may be coupled to tower 10 and to locking channel 65 in anchor block 30 in order to secure tower 10. FIG. 8 and FIG. 9 explain one embodiment of anchor rod 150 in greater detail. Anchor rod 150 comprises a first end 151, a second end 152, at least one shaft 155, an end rod 165, and an anchor head, which in this embodiment is formed as a connector plate 175. In the example, connector plate 175 and end rod 165 are welded to shaft 155, but other coupling methods are contemplated. Shaft 155 comprises a central axis 156 and a cross-section that may be round with a diameter of dimension D_155, may be square and defined by the dimension D_155, may be rectangular, or may be any other suitable shape as desired. A round cross-section will be assumed for convenience. Diameter D_155 is less than the width W_115 within locking channel 65. Anchor rod 150 may comprise carbon steel, a stainless steel, or any other suitable metal or non-metallic material. End rod 165 is disposed at first end 151 and comprises a central axis 166, a length of L_165, and a round cross-section with a diameter of D_165. Length L_165 is less than breadth B_65 of locking channel 65. Diameter D_165 is less than the width W_85, and in at least one embodiment, diameter D_165 is equal to diameter D_155. Shaft 155 is attached to the middle of end rod 165, and central axis 156 is perpendicular to central axis 166. As a result, first end 151 of anchor rod 150 comprises a "T-shape," defined by the intersection of shaft 155 and end rod 165. T-shaped first end 151 may be described as being enlarged in comparison to other axial positions along the shaft 155.

Continuing to reference FIG. 8 and FIG. 9, connector plate 175 comprises a first end 176, a second end 178, a face 182, and through-holes 184. First end 176 couples with shaft 155. At least one, but preferably a plurality of through-holes 184 pass through face 184 near second end 178. In the example shown, plate 175 includes five through-holes 184. Each through-hole 184 is suited to be a connection location for coupling at least one guy cable from tower 10 or another structure. In some embodiments, anchor rod 150 comprises more than one shaft 155. In some other embodiments, all or a portion of anchor rod 150 is covered by a corrosion resistant coating or surface finish 190.

Discussion of the installation and use of any embodiment or any component in this disclosure is merely representative of the possible uses of the disclosed equipment and should not be interpreted as limiting any embodiment or any component. While some of the capabilities or characteristics of the embodiment(s) and components are described, others may not be described but are within the scope of this disclosure. In one or more other instances, some modifications may be made to the sequence of the steps described below, to the number of steps performed, or to other factors.

Figure 10:
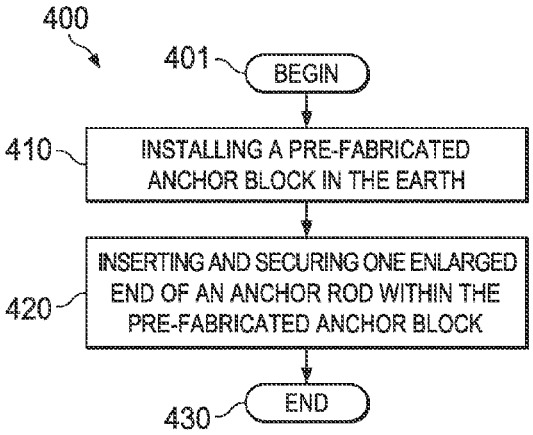
FIG. 10 is a flow chart of a method for installing a pre-fabricated anchor block in accordance with the principles disclosed herein.

Starting with FIG. 2, a method for the coupling of a pre-fabricated anchor block (such as anchor block 30), an anchor rod (such as a rotatable, removable anchor rod 150), and a tower (such as tower 10) or another structure will be described. In FIG. 2, anchor assembly 25 is prepared to couple a structure or object to be stabilized that is located (but not shown) to the left side of anchor assembly 25. FIG. 10 presents an installation method 400, which begins at 401 and ends at 430. Method step 410, includes installing a pre-fabricated anchor block (e.g. block 30) in the earth. Method step 420 includes inserting and securing one enlarged end of an anchor rod within the pre-fabricated anchor block. Additional steps may include any action described in this disclosure. Referring again to FIG. 2, before installation of an anchor block 30 and anchor rod 150, a user may determine prescribed values for the average installation depth Δ (delta) and installation angle α (alpha) for the pre-fabricated anchor block 30, and for the installation angle β (beta) of pre-fabricated anchor rod 150, which may be based on the height of tower 10, maximum anticipated wind speed for the location where tower 10 is located, the prevailing direction of the wind, or other factors. For convenience, angles α (alpha) and β (beta) are shown as elevation angles, measured from horizontal. Preferably, α (alpha) is greater than or equal to 0 degrees, and preferably, β (beta) is less than or equal to 90 degrees, at least when anchor assembly 25 couples to a tower located to the left side of FIG. 2. The installation site may be prepared by the removal of surrounding vegetation or by excavation of the general area around the site. During installation, a hole (not shown) is dug in the earth 14 to accommodate anchor block 30 at the prescribed average depth Δ (delta) and angle α (alpha) and to accommodate anchor rod 150 at an installation angle of β (beta). The dirt or other substance removed from the hole maybe set aside for later use. Anchor block 30 is placed in the hole with front end 36 closer to tower 10 than back end 38 and with the transverse center line 31 of the anchor block 30 (FIG. 4) radially aligned or generally radially aligned with the vertical axis 11 of tower 10. Subsequently, anchor rod 150 is installed in or coupled to anchor block 30. To accomplish this task, first end 151 of anchor rod 150 (FIG. 8) is inserted into the top opening 92 of T-shaped opening 72 (FIG. 7) and travels downward through long arm 95 of J-shaped portion 85. Simultaneously, a portion of shaft 155 enters top opening 122 of T-shaped opening 72 and into mid-portion 115. End rod 165 continues to travel in J-shaped portion 85, eventually being pulled generally upward into short arm 105, arriving at upper end 108. As a consequence, the enlarged, T-shaped first end 151 slidingly engages locking channel 65 with the result being that first end 151 rotatably couples within channel 65. Thereby, channel 65 of anchor block 30 couples or captures anchor rod 150 while anchor rod 150 remains free to rotate or pivot. For example, anchor rod 150 may pivot about axis 166 with shaft 155 moving within mid-portion 115.

Indicated in FIG. 4, a seal 80 may be coupled to an occupied (active) locking channel 65. In some embodiments seal 80 covers a portion of upper surface 41. For example, in some embodiments seal 80 covers a minor portion (i.e. less than 50%) of upper surface 41 and not a major portion. In some embodiments, seal 80 extends within channel 65. In yet another embodiment seal 80 both covers a portion of upper surface 41 and extends within channel 65. Seal 80 may be, for example, formed from rubber, adhesive tape, silicon, or caulking and may be pre-molded or configured on-site. When an anchor block 30 has more than one locking channel 65, any unused channel 65 may be covered or filled by a seal 80.

Referring now to FIG. 1 and FIG. 8, one or more guy cables may be coupled between the anchor rod and tower 10. The coupling may be accomplished using one or more through-holes 184 on connector plate 175 and, if desired, one or more turnbuckles 18. The hole in earth 14 is back-filled with fill material. Fill material may be the dirt or other substance that was previously removed from the hole or may be dirt or other substance from another source. Fill material may be natural or manmade. Back-filling covers and secures anchor block 30 within the earth 14 and, for some systems, covering a portion of anchor rod 150 within earth 14. During coupling, tension along axis 156 is developed in anchor rod 150 and each guy cable 12 by rotating turnbuckle(s) 18 or by another tensioning method. Perhaps best evaluated in reference to FIG. 2 and FIG. 7, the tensioning may rotate shaft 155 within mid-portion 115 and end rod 165 within upper end 108 of short arm 105. The tensioning pulls end rod 165 firmly within upper end 108 of short arm 105. Shaft 155 assumes a final angle β (Beta) that may differ from the target value of β determined previously. When installed as described, even as shaft 155 rotates within mid-portion 115, the tension on anchor rod 150 keeps end rod 165 firmly locked or captured within upper end 108 of locking channel 65. When anchor block 30 is disposed within earth 14 as described, and block 30 is coupled to anchor rod 150, tower 10, and at least one guy cable 12, then these components 30, 150, 10, 12 are thereby anchored to the earth 14 and may be said to be secured to the earth 14 or coupled to earth 14. Whether or not anchor block 30 is installed in a hole or covered with fill material, the force of gravity acting directly or indirectly on block 30 assists or facilitates the coupling between block 30 and earth 14. The securing or anchoring is not anticipated to counteract fully every force that may try to move one of the components 30, 150, 10, 12.

In another installation, a new anchor rod 150 may be installed and rotatably coupled in an existing anchor block 30, the block 30 being already installed in or adjacent the earth 14. In some situations, an existing anchor rod 150 may be removed from a multi-facetted locking channel 65 in the existing anchor block 30, and new anchor rod 150 may be installed in the same channel 65. In other situations, the new anchor rod 150 may be installed in a previously unused locking channel 65. If a seal 80 covers a locking channel 65, the seal would be removed or adjusted to allow engagement of the new rod 150. The installation steps described previously would be altered accordingly. The same or similar preparation, installation, and completion steps may be accomplished when anchoring another structure besides tower 10.

Figure 11:
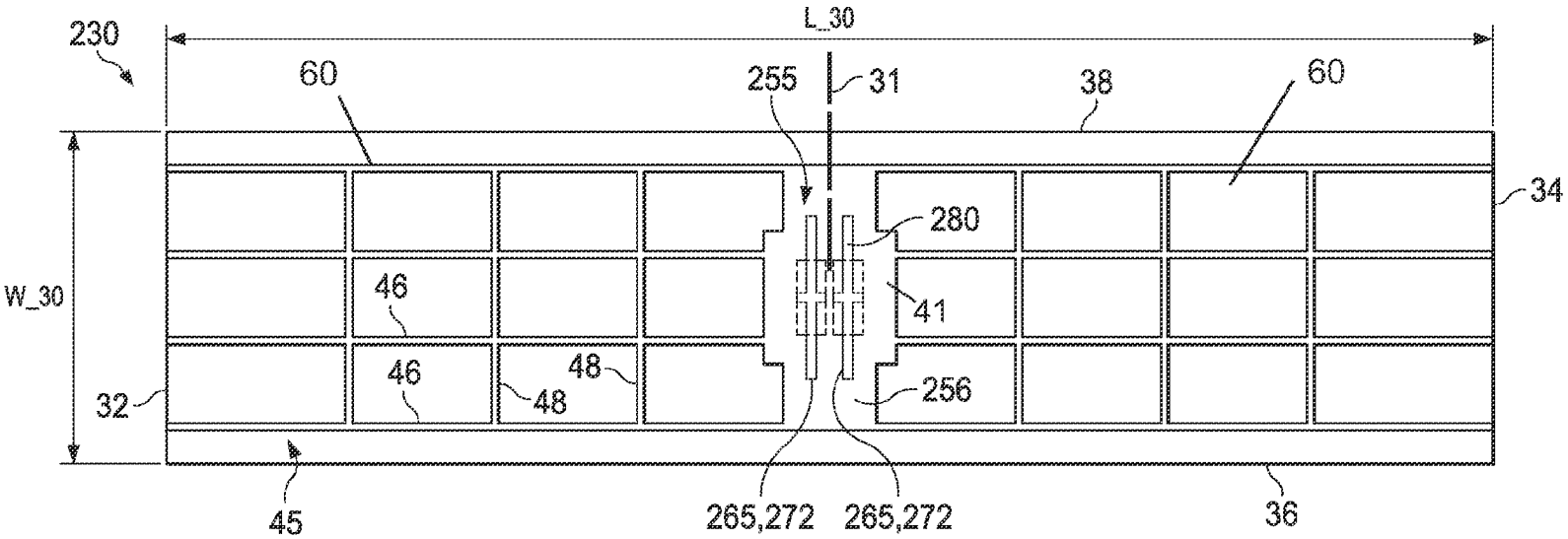
FIG. 11 is a top view of a pre-fabricated anchor block in accordance with the principles disclosed herein.

Referring to the embodiment shown in FIG. 11, pre-fabricated anchor block 230 may couple to tower 10 of FIG. 1. Anchor block 230 is similar to pre-fabricated anchor block 30 of FIG. 4, FIG. 5, and FIG. 6, except, for example, multi-facetted locking channel 265 in a body portion 255 replaces multi-facetted locking channel 65 in body portion 55. The combination of pre-fabricated anchor block 230 and rod 150 forms an embodiment of anchor assembly 25. Because many of the features on anchor block 230 are similar to corresponding features on anchor block 30, the discussion of block 230 will use some of the same identifiers as shown in the previously referenced figures or described elsewhere in this disclosure. A few of the similar aspects of anchor block 230 include first or left side 32, a second or right side 34, a front end 36, a back end 38, a base portion 45, a plurality of lateral structural ribs 46, a upper surface 41, a lower surface 42, and a plurality of transverse structural ribs 48. In the example shown, anchor block 230 has eight lateral ribs 46 that taper or slope and six transverse ribs 48 that intersect later ribs 46; however, other embodiments may have fewer or more of these features 46, 48. Anchor block 230 can also be described as having a pair of wing portions 60 extending from either side of body portion 255. The wing portions may be defined to include any of: the sloping ribs 46 that extend laterally from body portion 55, the lateral ribs 48, the base portion 45, and the recesses 52 disposed between the ribs 46.

Figure 12:
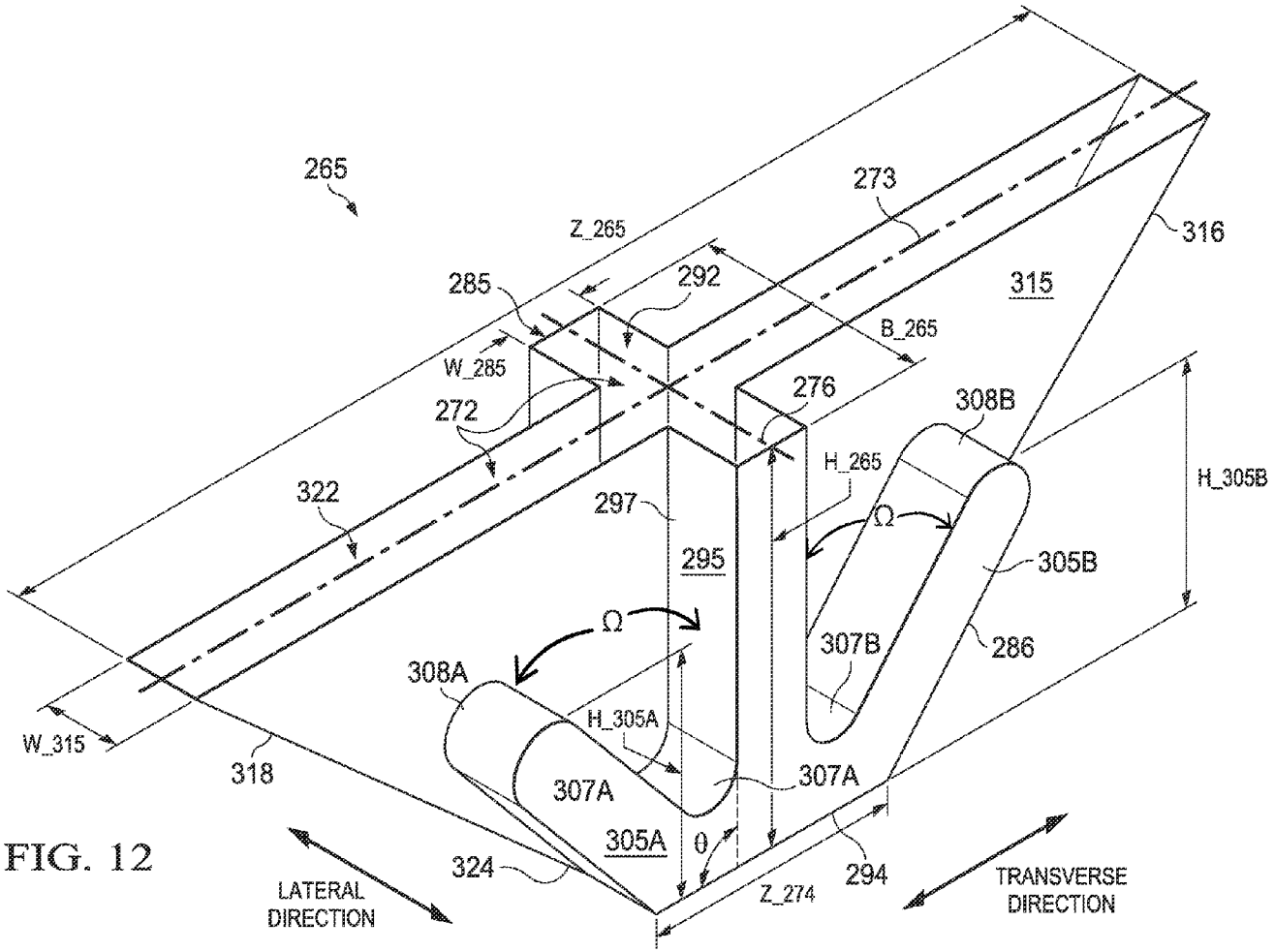
FIG. 12 is an isometric view of the locking channel of the pre-fabricated anchor block of FIG. 11.

Uniquely, anchor block 230 comprises body portion 255 with at least one multi-facetted locking channel 265, having a cross-shaped opening 272 extending through an upper surface 256, which is coincident with at least a portion of upper surface 41, and extending into central block 255. For the example shown, body portion 255 will also be called central block 255, and anchor block 230 has two locking channels 265. The voids formed by locking channel 265 are indicated by hidden lines (that is to say: dashed lines). A more complete view of the shape of a locking channel 265 is presented in FIG. 12. Cross-shaped opening 272 is clearly distinguishable. Cross-shaped opening 272 may be explained as a combination of a first rectangular opening 322 disposed perpendicular to and connected to second rectangular opening 292. Openings 322, 292 are connected at approximately their middles. The other surfaces (or equivalently "other facets") seen in FIG. 12 represent the interfacial surfaces between the voids of locking channel 265 and the remaining solid material of central block 255. Cross-shaped opening 272 is generally symmetric about a transverse centerline 273 and is also generally symmetric about lateral centerline 276. In some respect, the cross-shaped opening 272 comprises two overlapping T-shaped openings aligned along transverse centerline 273, wherein one T-shaped opening is flipped over lateral centerline 276.

FIG. 12 shows that each multi-facetted locking channel 265 further comprises a base 274, a mirrored J-shaped portion 285, and a mid-portion portion 315. Due to the inclusion of portions 272, 285, 315 or any two or more similar portions having similar form or function, locking channel 265 may be described as a channel with multiple portions or multiple sections. Locking channel 265 is characterized by a height H_265, a lateral breadth B_265, and a transverse depth Z_265. Height H_265 is less than anchor block height H_30. Height H_265 may be less than the difference between height H_30 and base height H_45 so that locking channel 265 does not extend into base portion 45. Breadth B_265 is less than block length L_30, and less than the lateral length of central block 255. Depth Z_265 is less than width W_30 and less than transverse width of central block 255.

Continuing with FIG. 12, mirrored J-shaped portion 285 comprises a back end 286, a front end 288, a top opening 292, a base 294, a long arm 295, two short arms 305A, 305B, lateral breadth of B_265, and a channel width W_285. Top opening 292 corresponds to the cross-member of cross-shaped opening 272. Long arm 295 comprises a front surface 297 and a generally parallel rear surface disposed a distance of W_285 from front surface 297. Long arm 295 extends into anchor block 30 from upper surface 41. If extended, front surface 297 would intersect base 294 forming an angle θ (theta). Even though surfaces 297 and 294 may not intersect, the angle θ describes the orientation of surface 297 and long arm 295 with respect to base 294. In the disclosed embodiment θ (theta) is approximately ninety degrees. However, arm 295 may instead slope laterally forward, causing θ (theta) to be less than 90 degrees, or arm 95 may slope laterally backward, causing θ (theta) to be greater than 90 degrees. A curved or filleted section 307A connects the first short arm 305A to long arm 295 in the vicinity of base 294. Short arm 305A slopes diagonally upward, away from long arm 295, and extends to a height of H_305A from base 294. Height H_305A is less than height H_265 so short arm 305A does not extend to upper surface 256 of central block 255. In the disclosed example, short arm 305A is disposed at an angle Ω (omega) with respect to long arm 295. In the example, the angle Ω (omega) has a value greater than zero degrees and less than 90 degrees. The upper end 308A of first short arm 305A may be, for example, rounded with a radius of curvature equal to half the width W_285. In at least one embodiment, the upper end 308A is generally flat, possibly parallel to top opening 292. For a channel 265 embedded within block 230, short arm 305A may be positioned closer to front end 36 than is long arm 295.

Mirrored J-shaped portion 285 of channel 265 comprises two overlapping J-shaped portions mirrored about the plane (not shown) that passes through lateral centerline 276, the two J-shaped portions sharing long arm 295 in common. The stated plane passing through centerline 276 would be vertical in the example of FIG. 12. The first J-shaped portion within mirrored J-shaped portion 285 may be explained as a combination of facets and features in central block 255 that form a first generally rectangular void, called long arm 295, joined with a curved or filleted void section 307A and joined with second rectangular void, called short arm 305A. Any of these sections 295, 307A, or 305A may have more or less curvature than depicted in FIG. 12. It is possible that long arm 295 be directly jointed or connected to short arm 305A with no curved or filleted section 307A between arms 295, 305A. In other embodiments with a longer transverse depth Z_274, section 307A may be longer.

The remainder of mirrored J-shaped portion 285 may also be understood from FIG. 12. The second short arm 305B of portion 285 may be essentially a mirror image of first short arm 305A, comprising similar characteristics. A curved or filleted section 307B connects the second short arm 305B to long arm 295 in the vicinity of base 294. Second short arm 305B is positioned further from surface 297 of arm 295 than is first short arm 305A. Arm 305B slopes diagonally upward, away from long arm 95, and extends to a height of H_305B from base 294. Height H_305B is less than height H_265, so short arm 305B does not extend to upper surface 256 of central block 255. In the disclosed example, short arm 305B is disposed at an acute angle with respect to long arm 295. Second short arm 305B comprises a rounded upper end 308B and is connected by a curved section 307B to long arm 295. In at least one embodiment (not shown), height of H_305B differs from height of H_305A. In at least one embodiment, the upper end 308B is generally flat, possibly parallel to top opening 292.

From the previously described geometry, the second J-shaped portion within mirrored J-shaped portion 285 may be explained as a combination of facets and features in central block 255 that form a first generally rectangular void (long arm 295) joined with a curved or filleted void (section 307B) and joined with second generally rectangular void (short arm 305B). Any of these sections 295, 307B, or 305B may have more or less curvature than depicted in FIG. 12. It is possible that long arm 295 be directly connected to short arm 305B with no curved or filleted section 307B between arms 295, 305B. In other embodiments with a longer transverse depth Z_274, section 307B may be longer. As stated earlier, the mirrored J-shaped portion 285, which includes long arm 295, sections 107A, 107B, short arms 305A, 305B, and upper ends 308A, 308B extends through the lateral breadth of B_265.

As indicated in FIG. 12, base 294 of mirrored J-shaped portion 285 generally defines a majority or all of base 274 of locking channel 265, spanning lateral breadth of B_265 and a transverse depth Z_274. Base 294 is shown to be generally flat and horizontal, but may be curved upward or downward in the transverse direction, that is to say, in a direction that may extend generally from front end 36 to the back end 38 of anchor block 230.

In the example locking channel 265 of FIG. 12, mid-portion 315 is superimposed through the center of mirrored J-shaped portion 285, sharing at least one or more common surfaces or one or more common volumes (voids). For this embodiment, mid-portion portion 315 has a trapezoidal shape and therefore may also be called trapezoidal portion. Mid-portion 315 comprises a back end 316, a front end 318, a top opening 322, a base 324, and a width W_315. In at least one embodiment, top opening 322 is parallel to base 324. In at least one embodiment, width W_315 is equal to width W_285. Top opening 322 corresponds to the elongate member of cross-shaped opening 272, extending a transverse depth Z_265 through and beyond the top opening 292 in two directions. In the example shown, the front end 318 extends beyond front end 288, back end 316 extends beyond back end 286, and base 324 overlaps a portion of base 294. However, in at least one embodiment, a region of front end 318 overlaps a region of front end 288, and in at least one embodiment a region of back end 316 overlaps a region of back end 286. Other derivations are possible.

Referring to FIG. 1 and FIG. 2, the installation and coupling of pre-fabricated anchor block 230 is similar to the installation and coupling of an anchor block 30 with a few adjustments. Previously described, steps 401 to 430 of method 400 in FIG. 10 also pertain to anchor block 230. During installation, a hole (not shown) is dug in the earth 14 to accommodate anchor block 230 at the prescribed average depth $\Delta$ and angle $\alpha$ and to accommodate anchor rod 150 at an installation angle of $\beta$. The dirt removed from the hole may be set aside for later use. Anchor block 230 may be placed within the hole in one of two orientations. Anchor block 230 may be placed in the hole with front end 36 closer to tower 10 than back end 38. Alternatively, anchor block 230 may be placed in the hole with back end 38 closer to tower 10 than front end 36. In either orientation, the transverse center line 31 of anchor block 230 is radially aligned or generally radially aligned with the vertical axis 11 of tower 10. (See also FIG. 11.) Subsequently, anchor rod 150 is installed in or coupled to anchor block 230. To accomplish this task, end rod 165 at first end 151 (FIG. 8) is inserted into the top opening 292 of cross-shaped opening 272 (FIG. 12) and travels downward through long arm 295 of mirrored J-shaped portion 285. Simultaneously, a portion of shaft 155 enters top opening 322 of cross-shaped opening 272 and into mid-portion 315. When end rod 165 reaches the bottom of long arm 295, anchor rod 150 would be preferably pulled toward front end 36 of anchor block 230 if front end 36 is closer to tower 10. Otherwise, if back end 38 is closer to tower 10, then anchor rod 150 would be preferably pulled toward back end 38. As a result, end rod 165, travels generally upward into a short arm 305A, 305B, preferably the short arm that is closer to tower 10. End rod 165 eventually arrives at an upper end 308A, 308B. As a consequence, the enlarged, T-shaped first end 151 slidingly engages locking channel 265 with the result being that first end 151 rotatably couples within channel 265. Thereby, channel 265 of anchor block 230 couples or captures anchor rod 150 while anchor rod 150 remains free to rotate or pivot. For example, anchor rod 150 may pivot about axis 166 with shaft 155 moving within mid-portion 315.

Indicated in FIG. 11, a seal 280 may be coupled to an occupied (active) locking channel 265. In one embodiment seal 280 covers a portion of surface 256. In another embodiment, seal 280 extends within channel 265. In yet another embodiment seal 280 both covers a portion of surface 256 and extends within channel 265. Seal 280 may be, for example, formed from rubber, adhesive tape, silicon, or caulking and may be pre-molded or configured on-site. When an anchor block 230 has more than one locking channel 265, any unused channel 265 may be covered by a seal 280.

The remainder of the installation of anchor block 230 is similar to the installation of anchor block 30 as previously discussed. Similar to the view of FIG. 1, when anchor block 230 is disposed within earth 14 as described, and block 230 is coupled to anchor rod 150, tower 10, and at least one guy cable 12, then these components 230, 150, 10, 12, are thereby anchored to the earth 14 and may be said to be secured to the earth 14 or coupled to earth 14.

In another installation, a new anchor rod 150 may be installed and rotatably coupled in an existing anchor block 230 already installed in the earth 14. In some situations, an existing anchor rod 150 may be removed from a multi-facetted locking channel 265 in the existing anchor block 230, and new anchor rod 150 may be installed in the same channel 265. In other situations, the new anchor rod 150 may be installed in a previously unused locking channel 265. If a seal 280 covers a locking channel 265, the seal would be removed or adjusted to allow engagement of the new rod 150. The installation steps described previously would be altered accordingly.

Figure 13:
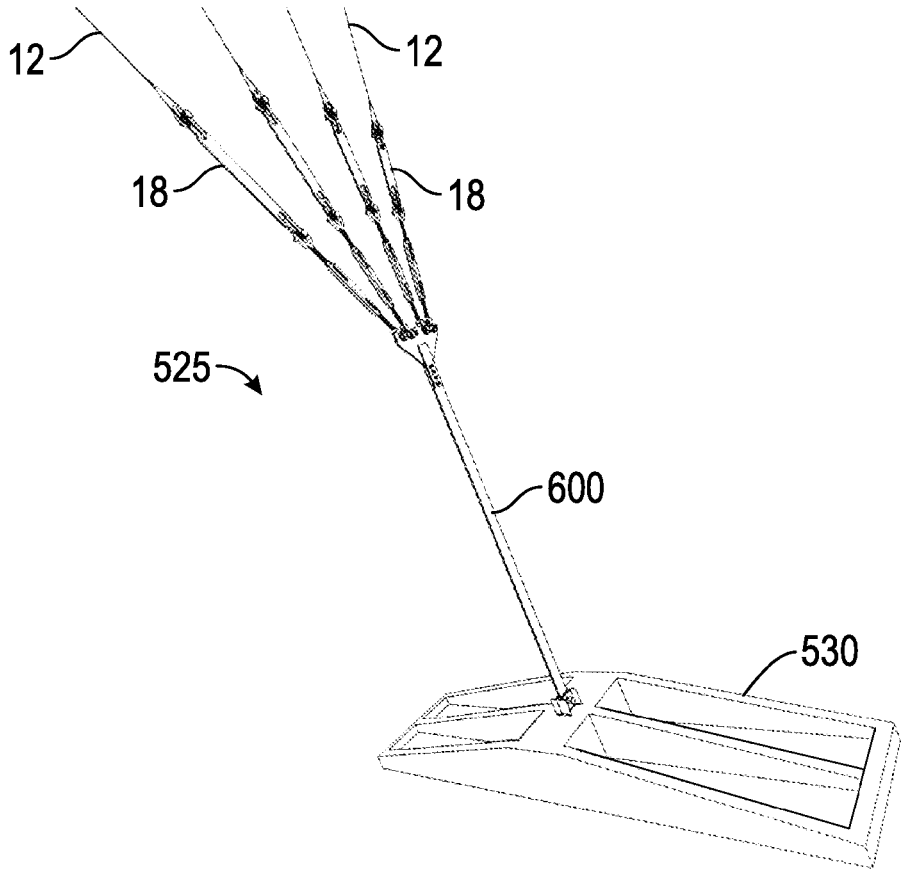
FIG. 13 is a perspective view of an anchor assembly having a pre-fabricated anchor block and a rotatable, removable anchor rod in accordance with the principles disclosed herein.

FIG. 13 shows another embodiment of an anchor assembly suited for coupling to anchored tower 10 of FIG. 1 or coupling another object to be stabilized against movement. In FIG. 13, anchor assembly 525 includes a pre-fabricated anchor block 530 and an anchor rod assembly 600. Anchor assembly 525 may also be called anchor 525. Some steps or operations of method 400 apply to the installation of anchor assembly 525. Anchor assembly 525 is suitable for above-ground, subterranean, or marine installation.

Figure 14:
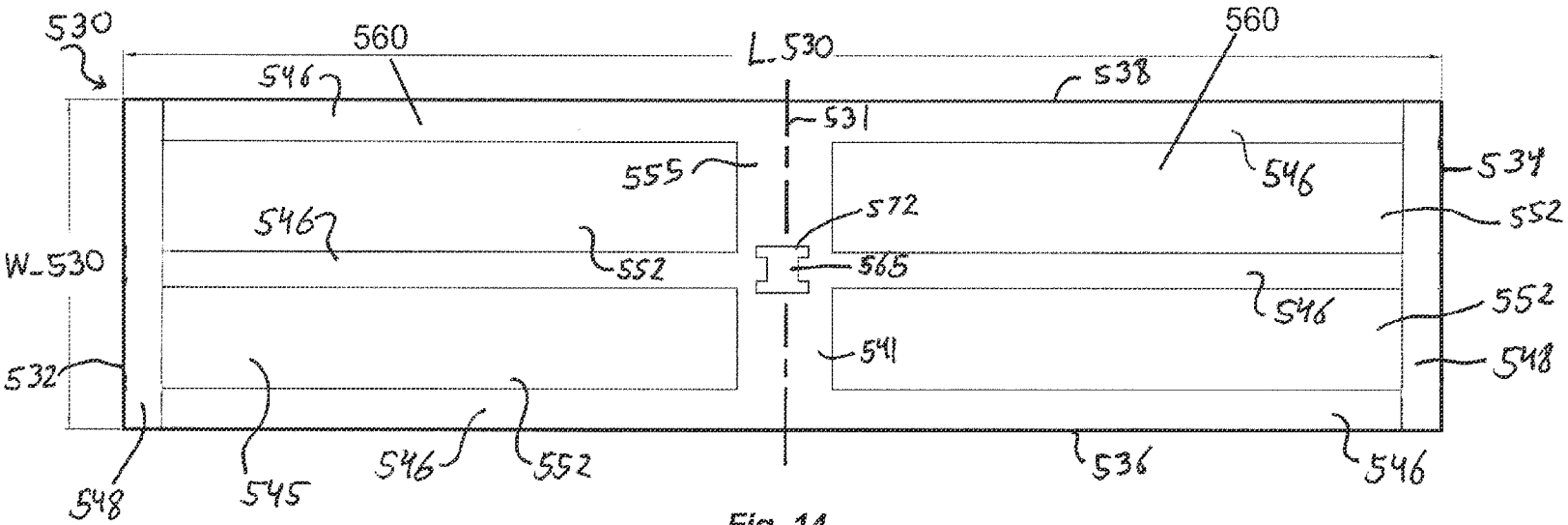
FIG. 14 is an top view of a the pre-fabricated anchor block shown in FIG. 13 in accordance with the principles disclosed herein.
Figure 15:
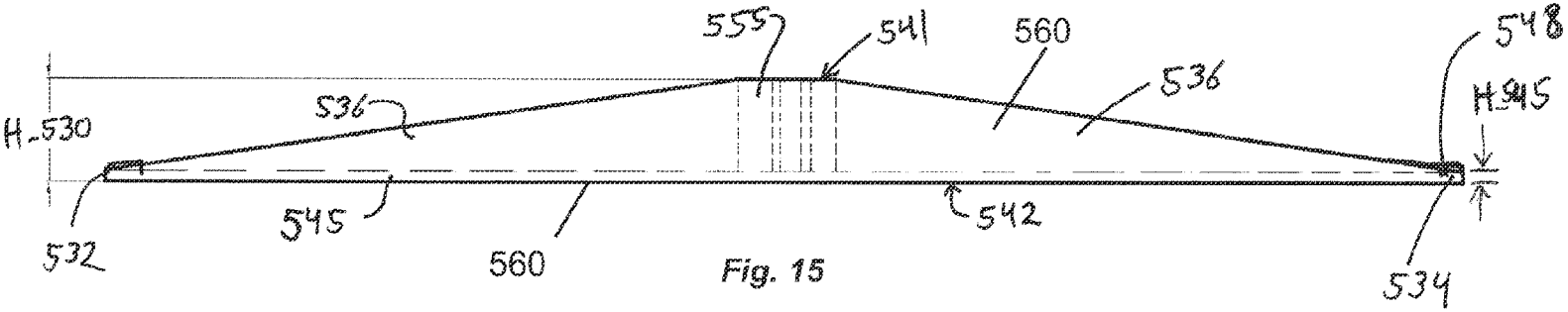
FIG. 15 is an front view of the pre-fabricated anchor block of FIG. 14.

As shown in FIG. 14, pre-fabricated anchor block 530 is generally rectangular when viewed from the top view. As shown in FIG. 15, the front profile of anchor block 530 is generally trapezoidal with an upper surface 541 generally parallel to a lower surface 542. The outermost dimensions of anchor block 530 are a transverse width of W_530, a lateral length of L_530, and a height of H_530. Anchor block 530 comprises, a first or left side 532, a second or right side 534, a transverse center line 531 between sides 532, 534, a first end 536, a second end 538, a base portion or base plate 545, a plurality of lateral structural ribs 546, a plurality of transverse structural ribs 548, a body portion 555 coupled to base portion 545, and at least one through-channel 565 extending entirely through the base portion 545 and the body portion 555. Through-channel 565 is configured to couple an anchor rod assembly to anchor block 530. Some embodiments have multiple through-channels 565. In the example of FIG. 14, body portion 555 is symmetrically positioned about center line 531 and may also be called central block 555. Upper surface 541 and lower surface 542 are examples of outer surfaces of anchor block 530. As used herein, the term "coupling-channel" shall mean and include both through-channels, such as 565 and 965 (965 to be described later), as well as the earlier-described multi-facetted locking channels, such as 65 and 265.

Continuing to reference FIG. 14 and FIG. 15, base portion 545 is generally rectangular and comprises a thickness H_545. Base portion 545 extends laterally from left side 532 to right side 534 and extends in a perpendicular, i.e. transverse, direction from first end 536 to second end 538. Body portion 555 comprises a lateral length smaller than L_530 and extends transversely from first end 536 to second end 538. Body portion 555 couples (e.g. is affixed to or integral with) base portion 545 and extends in a direction away from the base portion 545. The combined height of base portion 545 and body portion 555 corresponds to the height H_530. Body portion 555 shares at least a portion of upper surface 541 with anchor block 530.

In the example shown, a first plurality of the lateral structural ribs 546 extend from the body portion 555 toward the left side 532, and a second plurality of the lateral structural ribs 546 extend from the body portion 555 toward the right side 534. The transverse ribs 548 extend between first end 536 and second end 538 and intersect ribs 546. More particularly, in FIG. 14, anchor block 530 has six lateral ribs 546 and two transverse ribs 548; however, some embodiments have fewer or more ribs 546, 548. In the example of FIG. 15, the height of lateral ribs 546 tapers or slopes from body portion 555 down to lesser height near the sides 532, 534. The heights of transverse ribs 548 match the adjacent portion of the intersected lateral ribs 546. Best shown in FIG. 14, a plurality of empty recesses 552 are located between the ribs 546, 548. Recesses 552 may have any of the characteristics described for recesses 52 of anchor block 30 (FIG. 4).

Anchor block 530 can also be described as having a pair of wing portions 560 extending from either side of the body portion 555. The wing portions may be defined to include any of: the sloping ribs 546 that extend laterally from body portion 555, the lateral ribs 548, the base portion 545, and the recesses 552 disposed between the ribs 546.

Figure 16:
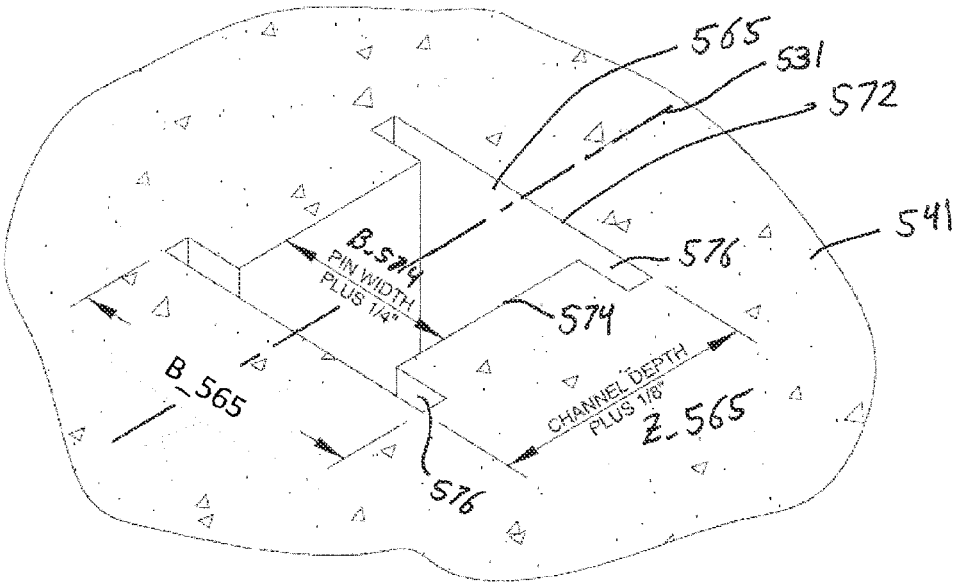
FIG. 16 is an close-up isometric view of the through-channel of the pre-fabricated anchor block of FIG. 14.

As shown in the example of FIG. 14, through-channel 565 has a cross-section 572 similar to the shape of a capital letter "i" with serifs. That is to say, the shape of cross-section 572 is generally similar to the cross-sectional shape of an I-beam, which could be received in through-channel 565. As best shown in FIG. 16, through-channel 565 includes a central portion 574 and a first and second cross-portions 576 located at opposite ends of central portion 574. Each of the portions 574, 576 of channel 565 is centered on transverse centerline 531 with cross-portions 576 extending perpendicular to centerline 531. In some embodiments, the I-shaped cross-section 572 may be rotated to achieve a different orientation of channel 565 with respect to centerline 531 than is shown, or of channel 565 maybe offset with respect to centerline 531. The cross-section 572 of channel 565 is characterized by a lateral breadth B_565, and a transverse depth Z_565. The height that channel 565 extends from upper surface 541 to lower surface 542 is equal to the height H_530 of anchor block 530. First and second cross-portions 576 extend the full channel breadth B_565, but central portion 574 has a lateral breadth B_574 that is less than the full channel breadth B_565, at least in the embodiment shown.

Figure 17:
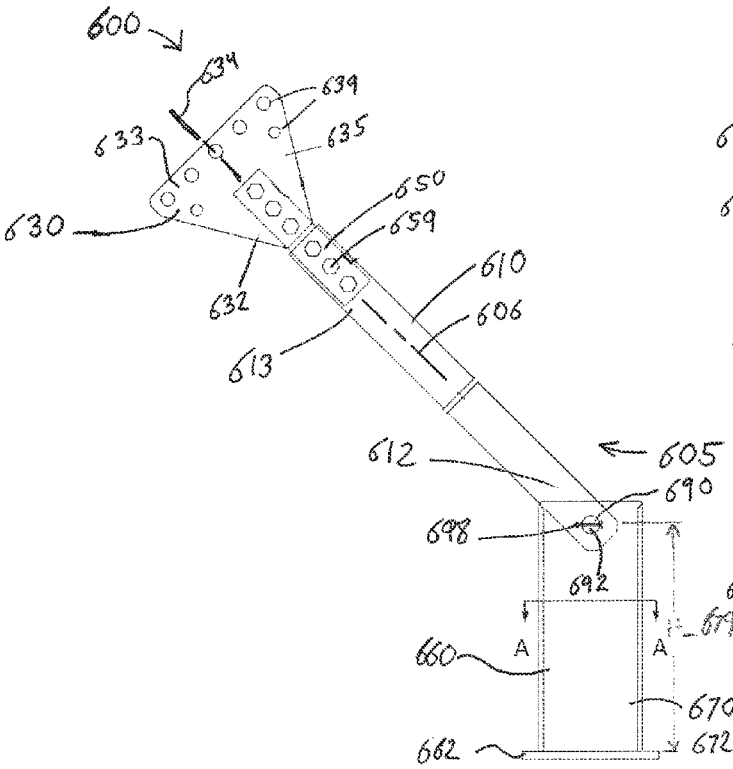
FIG. 17 is an front elevation view of the anchor rod assembly shown in the anchor assembly of FIG. 13 having an anchor rod and a mooring member in accordance with the principles disclosed herein.
Figure 18:
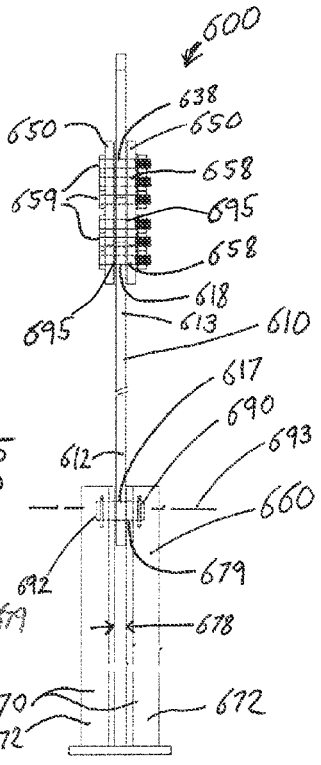
FIG. 18 is a side elevation view of the anchor rod assembly of FIG. 17.

FIG. 17 and FIG. 18 present anchor rod assembly 600 in greater detail. Anchor rod assembly 600 includes an anchor linkage or anchor rod 605 configured to couple the anchor block 530 to an object to be stabilized, for example tower 10 of FIG. 1. Anchor rod assembly 600 further includes a mooring member 660 and a rotatable coupling 690.

Referring still to FIG. 17 and FIG. 18, anchor rod 605 includes a longitudinal axis 606, an elongate anchor shaft 610, an anchor head, which in this embodiment is a connector plate 630, and two splicing members 650 couple the shaft 610 to the connector plate 630. In the example, anchor rod 605 is a generally rigid assembly.

Best shown in FIG. 18, anchor shaft 610 is rectangular in cross-section and includes a first end 612, a second end 613, through-hole 617 at first end 612, and a plurality of through-holes 618 at second end 612. Three through-holes 618 aligned with axis 606 are shown at second end 613, but other embodiments may have one, two, or any practical number of through-holes 618 in the same or any suitable pattern.

Connector plate 630 comprises, a first end 632, a second end 633 opposite first end 632, a central axis 634 extending through ends 632, 633, a face 635, plurality of through-holes 638 at first end 632, and a plurality of through-holes 639 at second end 633. Three axially-aligned through-holes 638 are shown at first end 632, but other embodiments may have one, two, or any practical number of through-holes 638. Seven through-holes 639 are shown at second end 633 symmetrically distributed about axis 634, but other embodiments may have one, two, or any practical number of through-holes 639 positioned at suitable locations. Each through-hole 639 is suited to couple a guy cable 12 or a turnbuckle 18 from tower 10 or another object. The two splicing members 650 are elongate rectangular plates each having a plurality of through-holes 658 along the length of member 650. A first group of through-holes 658 are configured to align with through-holes 618 at second end 613 of anchor shaft 610. A second group of through-holes 658 are configured to align with through-holes 638 at base end 632 of connector plate 630. Fasteners 659, such as bolts held by lock washers and nuts for example, couple the two splicing member 650 to anchor shaft 610 and to connector plate 630 by pairs of through-holes 618, 658 and pairs of through-holes 638, 658, respectively.

Figure 19:
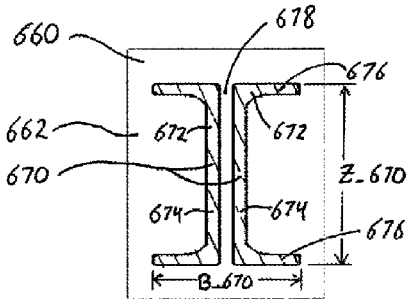
FIG. 19 shows a sectional top view of the mooring member of FIG. 17 as viewed from sectional plane A-A.

Referring again to FIG. 17 and FIG. 18, mooring member 660 includes a base plate 662 and an elongate body 670 extending from base plate 662. Body 670 comprises two spaced-apart channel members 672. As more clearly seen in the sectional view A-A of FIG. 19, Channel members 672 are three-sided, each comprising a central web member 674 and two flanges 676 forming right angles at the elongate edge of central web 674. Channel members 672 are made from pre-fabricated channel stock in some embodiments and are custom built in other embodiments. As shown in FIG. 19, body 670 is characterized by a breadth B_670, defined to extend in the direction of flanges 676, and is characterized by a depth Z_670, defined to extend in the direction of webs 674. Referring to both FIG. 19 and FIG. 16, body breadth B_670 is less than channel breadth B_565, and body depth Z_670 is less than channel depth Z_565. As best shown in FIG. 18, the webs member 674 of channel members 672 of body 670 are spaced-apart by a gap 678, that is equal to or greater the thickness of anchor shaft 610 to allow shaft 160 to rotate.

Continuing to reference FIG. 18, an aperture 679 passes through the upper end of central web 674 on both channel members 672 at a height of H_679 from the top of base plate 662. In at least some embodiments, aperture height of H_679 above base plate 662 is less than the height H_530 of anchor block 530 (FIG. 15). In anchor rod assembly 600, the first end 612 of anchor shaft 610 is slidingly received within the gap 678 between the two webs 674 of mooring member body 670. Aperture 679 acts as a member of rotatable coupling 690, being aligned with through-hole 617 of anchor shaft 610 and rotatably receiving the pin 692. Anchor shaft 610 is rotatable about pin axis 693, capable of rotating within a geometric plane parallel to webs 674. Mooring member 660 may be formed as a weldment by welding together two or more separate pieces that comprise base plate 662 and body 670. Or, mooring member 660 may be formed by casting a single piece defining base plate 662 and body 670, by machining, or by any other suitable technique.

In this embodiment, rotatable coupling 690 includes a pin or cylindrical shaft 692 having a central axis 693 and configured to extend through anchor rod 605 and mooring member 660. As shown, pin 692 extends beyond anchor rod 605 and both webs 674 of mooring member body 670. A cotter key 698 is positioned in a through-hole at each end of pin 692 and positioned outside mooring member body 670. The two cotter keys 698 maintain the relative positions of anchor rod 605, member 660, and pin 692. The rotatable coupling 690 allows relative rotation of the anchor rod 605 with respect to the mooring member 660 and the anchor block 530 (FIG. 13).

Various members of anchor rod assembly 600 are formed from ASTM A572 Grade B55 steel, stainless steel 2025, carbon steel treated for corrosion resistance (e.g. having a galvanized coating), or other suitable material, which may include metallic or non-metallic material. In one example, anchor shaft 610 and mooring member 660 are formed from a stainless steel, and connector plate 630, splicing members 650, and fasteners 659 are formed from galvanized steel. Thus, various members of anchor rod 605 may be formed from different materials. In this example, a plurality of electrical insulating members 695 are installed to separate the anchor shaft 610 from the splicing members 650 and fasteners 659 to reduce or eliminate the potential for corrosion that could occur when dissimilar metals contact each other. The electrical insulating members 695 may also reduce or eliminate the potential for a lightning strike to travel from a guy cable 12 to anchor shaft 610 or anchor block 530. Though not shown in detail, the electrical insulating members 695 may include a plurality of sleeves or sleeve portions around fasteners 659 and may also include a plurality of annular washers or a plate portion between anchor shaft 610 and each splicing member 650. Alternatively, electrical insulating members 695 may be formed as a coating on splicing members 650 or on anchor shaft 610. Pin 692 of rotatable coupling 690 is formed from ASTM A193 Grade B7 steel or other suitable material, which may be non-metallic or may be one of the other materials mentioned herein. For example, in some embodiments, pin 692 is formed from the same material as mooring member 660 or connector plate 630. In another example, various members of anchor rod assembly 600 are formed from a single type of material, such as, one of the materials previously discussed. Some embodiments do not include electrical insulating members 695.

Figure 20:
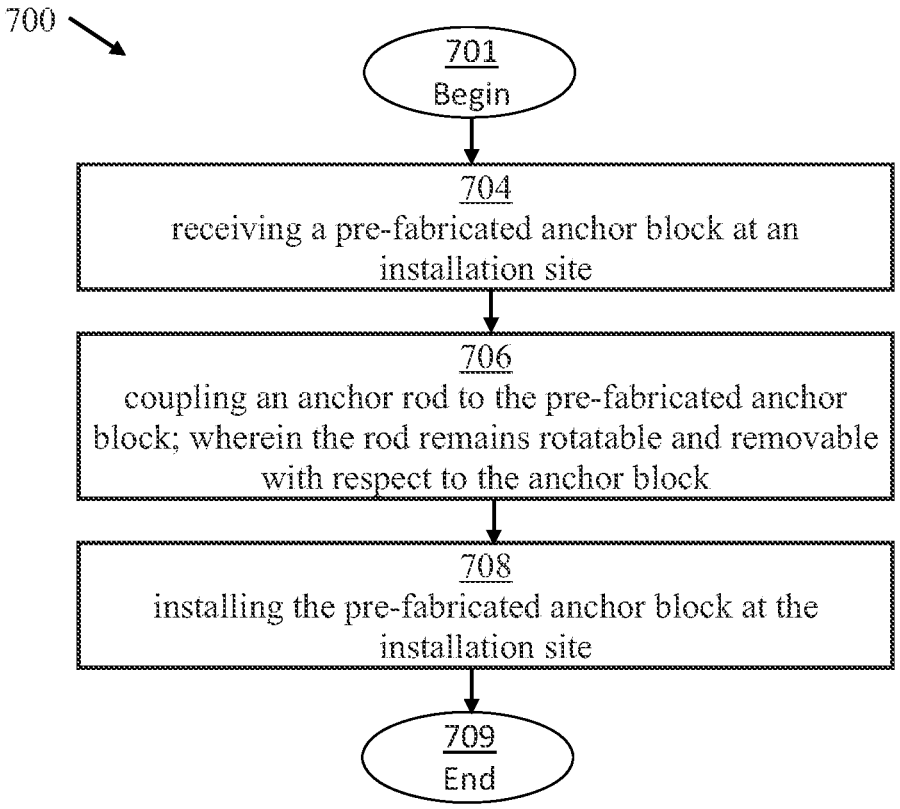
FIG. 20 is a flow chart of a method for installing a pre-fabricated anchor block in accordance with the principles disclosed herein.

FIG. 20 presents a method 700 for installing an anchor assembly. Although various aspects of method 700 will be described in terms of anchoring assembly 525, method 700 is applicable to other anchoring systems made in accordance with the principles disclosed herein. Method 700 starts at block 701 and ends at block 709. At step 704, method 700 includes receiving the pre-fabricated anchor block at an installation site where the anchor block is to be installed to couple and stabilize an object, such as tower 10 for example. The installation site may also be called a job site. Step 706 includes coupling an anchor rod to the pre-fabricated anchor block; wherein the rod remains rotatable and removable with respect to the anchor block. Step 708 of method 700 includes installing the pre-fabricated anchor block at the installation site.

Many variations to method 700 are possible in accordance with the principles disclosed herein. Some embodiments of method 700 include additional steps, and others may include fewer steps than shown in FIG. 20. For example, in at least some situations, a pre-fabricated anchor block is fabricated at a second location different than, i.e. separated from, the installation site prior to prior to receiving the pre-fabricated anchor block at the installation site. In other instances, pre-fabricated anchor block may be fabricated at one location at the installation site, prior to being received for installation at a second location also at the installation site. Both methods differ from the technique used for the conventional, poured-in-place anchor block and rod 20 of FIG. 3. Other additional steps for method 700 may include any of the following: (a) coupling one or more guy cables to the anchor rod and to an object that is to be stabilized, which may be performed in a manner described for anchor rod 150 for example, and (b) any other concept described or taught within this disclosure. In some instances, modifications may be made to the sequence of the various steps of method 700.

Figure 21:
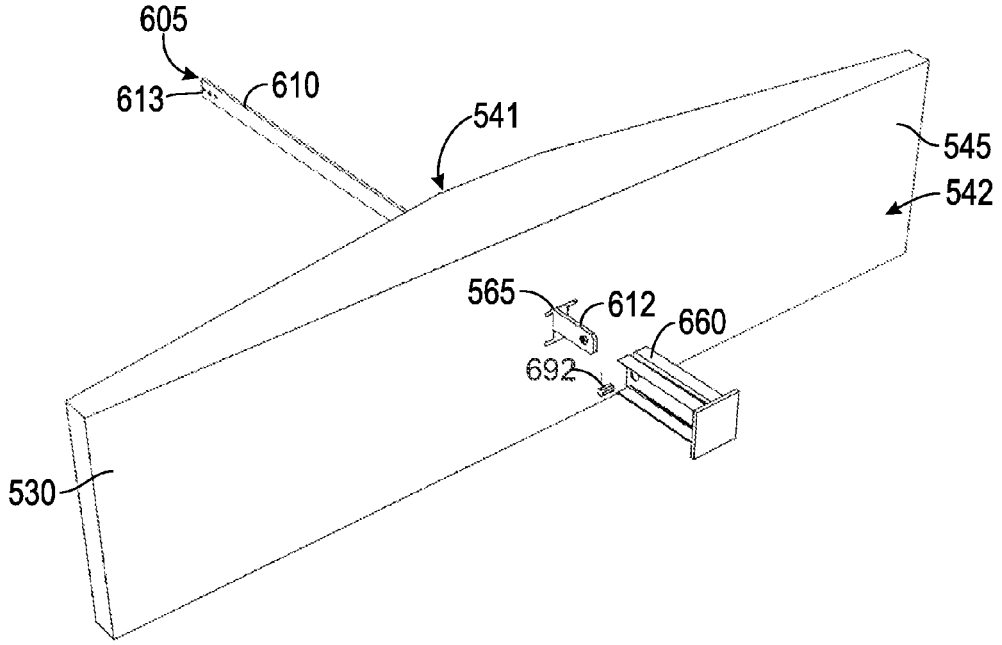
FIG. 21 is perspective view of the bottom of the anchor assembly of FIG. 13 during an exemplary stage of installation in accordance with the principles disclosed herein.
Figure 22:
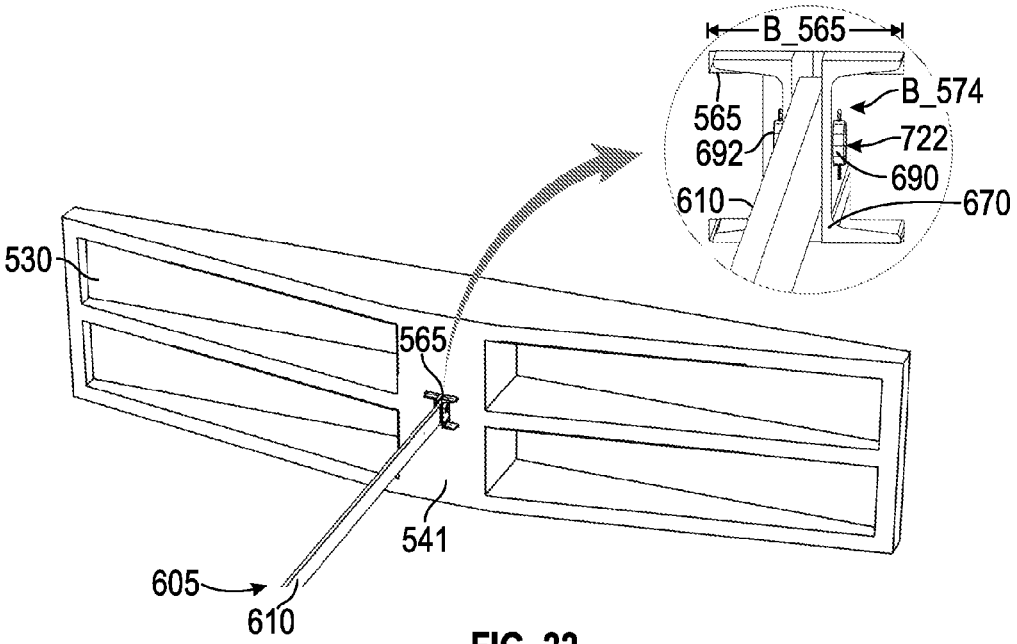
FIG. 22 is a perspective view of the top of the anchor assembly of FIG. 13 during another exemplary stage of installation in accordance with the principles disclosed herein.

FIG. 21 and FIG. 22 present an example of step 706, which involves coupling an anchor rod to the pre-fabricated anchor block. In FIG. 21, an end portion of anchor rod or anchor linkage 605 has been slid through the through-channel 565 of anchor block 530. More specifically, in this instance, anchor shaft 610 is shown within the through-channel 565, and first end 612 extends beyond base portion 545 and lower surface 542 while second end 613 of shaft 610 extends beyond upper surface 541. Mooring member 660 and pin 692 are positioned adjacent first end 612 of shaft 610 and adjacent base portion 545. A next step includes rotatably coupling the anchor rod 605, e.g. shaft 610, to mooring member 660 using pin 692 and cotter keys 698 (FIG. 18).

FIG. 22 displays a result of retracting the anchor rod until the mooring member is at least partially disposed within the channel of the anchor block. In FIG. 22, the mooring member body 670 is entirely or almost entirely positioned within channel 565 when base plate 662 seats against or adjacent base portion 545. Mooring member base plate 662 is configured to remain adjacent the lower surface 542, being too large laterally or transversely to enter channel 565, restraining mooring member 660 against passing entirely through the through-channel 565. As stated previously, in at least this embodiment, the height of H_679 of aperture 679 from base plate 662 is less than the height H_530 of anchor block 530 (FIG. 15). Thus, the rotatable coupling 690 is positioned totally or at least partially within channel 565, adjacent or below upper surface 541 of anchor block 530. Shaft 610 of anchor rod 605 extends from rotatable coupling 690, extending beyond the through-channel 565 and upper surface 541, opposite the base portion 545 of the anchor block 530 and opposite mooring member base plate 662. In this and various other embodiments, cylindrical shaft or rod 690 remains at least partially disposed within the through-channel 565 of the anchor block 530 when body 670 of the mooring member 660 extends within the through-channel 565, preventing or delaying a failure of anchor rod assembly 600 as will be explained next.

An inset image within FIG. 22 shows an enlarged view of rotatable coupling 690 positioned within channel 565. In this view, spacing or gaps are evident between mooring member body 670 and various portions of channel 565 because body breadth B_670 is less than channel breadth B_565, and body depth Z_670 is less than channel depth Z_565 (FIG. 16 and FIG. 19). In an example, body breadth B_670 is less than channel breadth B_565 by one-eight inch (0.125"=0.318 mm), and body depth Z_670 is less than channel depth Z_565 by one-eight inch (0.125"=0.318 mm). As also shown FIG. 22, the length of pin 692 is less than the lateral breadth B_574 of channel central portion 574. In an example, length of pin 692 is less than the breadth B_574 by one-quarter inch (0.25"=0.635 mm). Therefore, on average, a gap 722 of one-eight inch exists between each end of pin 692 and the adjacent wall of channel 565 central portion 574. Gap 722 allows pin 692 to rotate without contacting the adjacent walls of channel 565 when cotter keys 698 are intact. In at least some embodiments, the length of pin 692, the breadth B_574 of channel central portion 574, and the thickness of webs 674 of channel members 672 are chosen or designed so that rotatable coupling 690 remains intact and functional even if a cotter key 698 were to fail. For example, if a cotter key 692 broke due to corrosion, pin 692 might move along pin axis 693, but pin 692 would remain engaged with both channel members 672 of body 670, i.e. fully engaged within aperture 679, and would remain engaged with through-hole 617 of anchor shaft 610, preventing or delaying a failure of anchor rod assembly 600. Even so, in some embodiments, rod 690 is located completely outside the through-channel 565 of the anchor block 530 and beyond upper surface 541.

Figure 23:
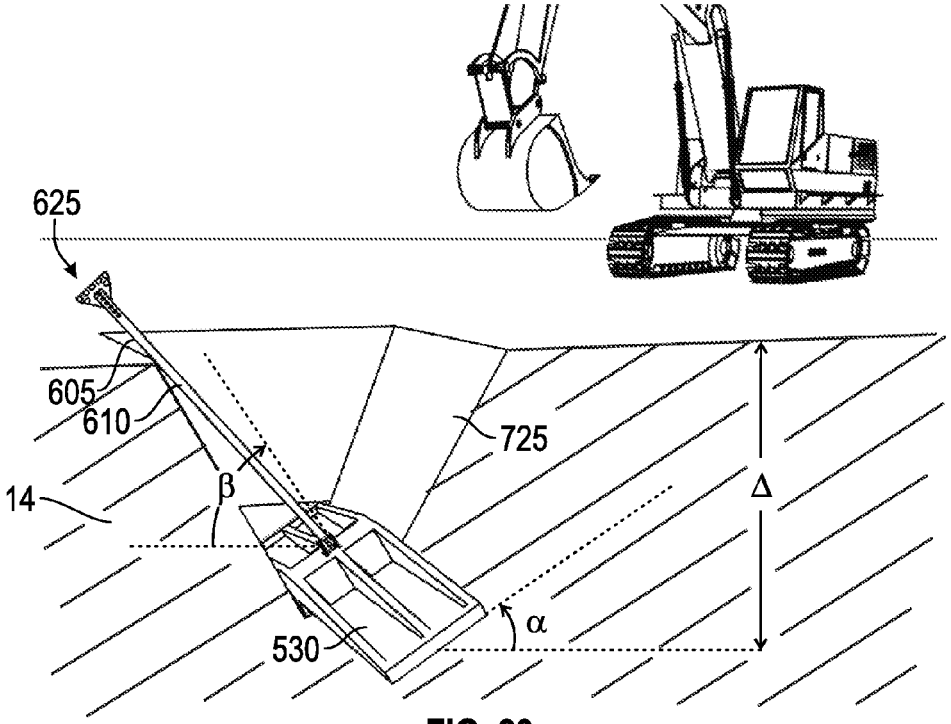
FIG. 23 is a perspective view of the anchor assembly of FIG. 13 placed in a hole in the earth during still another exemplary stage of installation in accordance with the principles disclosed herein.

FIG. 23 shows an example of step 708, which involves installing the pre-fabricated anchor block at the installation site. Again, anchor shaft 610 is shown as a representative portion of anchor rod 605. In FIG. 23, a representative hole or recess 725 has been dug below the surface of the earth 14. Anchor assembly 525 has been placed in a hole 725 in preparation for coupling an object to be stabilized that is located (but not shown) to the left side of anchor assembly 525. Before digging hole 725 or installing anchor block 530 and anchor rod 150, a user may determine prescribed values for the average installation depth Δ (delta) and installation angle α (alpha) for the pre-fabricated anchor block 530, and for the installation angle β (beta) of pre-fabricated anchor rod 150, which may be based on the size of the object to be stabilized, maximum anticipated wind speed for and the prevailing direction of the wind the installation site, or other factors. For convenience, angles α (alpha) and β (beta) are shown as elevation angles, measured from horizontal.

The hole 725 includes a plurality of wall regions that allow anchor block 530 and anchor rod 605 to accommodate anchor block 30 at the prescribed average depth Δ (delta) and angle α (alpha) and to accommodate anchor rod 150 at an installation angle of β (beta). The shape of hole 725 is anticipated to vary between different implementations or embodiments of method 700. An end of anchor shaft 610 extends out of the earth 14. As shown, anchor shaft 525 has not yet achieved the targeted installation angle β (beta). Another operation is to back-fill hole 725 with fill material to add weight over anchor block 530, which provides the potential for additional tension or holding strength for anchor rod 605. Thus, in some embodiments, method 700 further includes digging a hole in the earth 14, placing the pre-fabricated anchor block within the hole, and covering the pre-fabricated anchor block with fill material.

FIG. 21, FIG. 22, and FIG. 23 depict the anchor shaft 610 as representative portion of anchor rod 605 during various exemplary stages of method 700 as may be applied to anchor rod assembly 600. When applying method 700, connector plate 630 and splicing member 650 may be coupled to anchor shaft 610 to complete the assembly of anchor rod 605 (FIG. 17) at any convenient stage of operation, for example before the stage depicted in FIG. 21, after the stage depicted in FIG. 23, or between the stages depicted in FIG. 21 and FIG. 23. After connector plate 630 is coupled to anchor shaft 610, a guy cable 12 and turnbuckles 18 (FIG. 1) may be coupled between anchor rod assembly 600 and the object to be stabilized (e.g. tower 10). Alternatively, in some embodiments, a guy cable 12 or turnbuckles 18 (FIG. 1) may be coupled to anchor shaft 610 and the object to be stabilized without any intervening connector plate 630 or splicing member 650.

In some embodiments of method 700, anchor rod assembly 600 is coupled to the object to be stabilized without anchor rod assembly 600 being placed within a hole or without anchor rod assembly 600 being partially covered with fill material. For example, anchor rod assembly 600 may be placed on the surface of the earth 14 with no material covering it. In some embodiments of method 700, step 708 includes submerging anchor rod assembly 600 within a body of water, such as an ocean for example. When submerged, anchor rod assembly 600 may be located within a man-made hole or may be located at bottom of the body of water without being located in a man-made hole, for example directly on the floor of the ocean. When submerged, anchor rod assembly 600 may be covered with fill material to add weight and provide the potential for additional tension or holding strength for anchor rod 605. By using method 700 in one of its various embodiments, anchor assembly 525 and any coupled object are thereby anchored to the earth 14 and may be said to be secured to the earth 14 or coupled to earth 14.

In some instances, a new anchor rod 605 may be installed and rotatably coupled in an existing anchor block 530, the block 530 being already installed in or adjacent the earth 14. In some situations, an existing anchor rod 605 may be disconnected from and existing mooring member 660, and new anchor rod 605 may be coupled to the same mooring member 660.

Some embodiments of method 700 using some of the steps or operations previously described are applicable to anchor assembly 25 of FIG. 2 using either pre-fabricated anchor block 30, 230. For example, in some embodiments, step 706, which includes coupling an anchor rod to the pre-fabricated anchor block, further involves sliding an enlarged end of the anchor rod into a multi-facetted locking channel configured to receive and capture the enlarged end. Referring to FIG. 7 and FIG. 8, this version of step 706 is exemplified by inserting first end 151 of anchor rod 150 into the top opening 92 of T-shaped opening 72 of locking channel 65. The process continues by sliding rod end 151 through J-shaped portion 85 until rod end 151 engages short arm 105, arriving at upper end 108. In this manner, the enlarged, T-shaped first end 151 slidingly engages locking channel 565. With tension or a rotational moment applied to anchor rod 150, T-shaped first end 151 is captured or retained within channel 65 while anchor rod 150 remains free to rotate or pivot.

Figure 24:
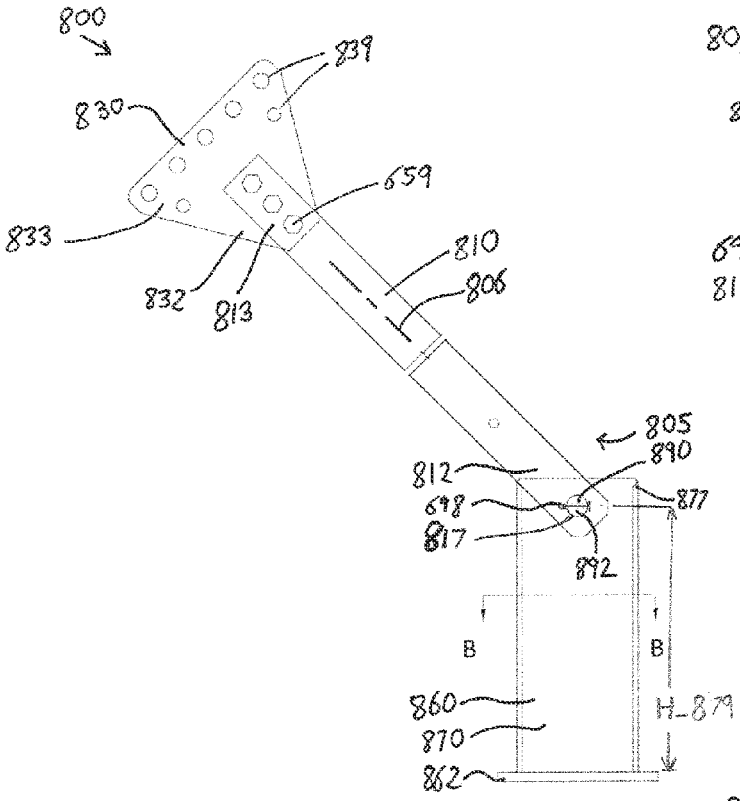
FIG. 24 is an front elevation view of the anchor rod assembly compatible with the anchor assembly of FIG. 13 and having an anchor rod and a mooring member in accordance with the principles disclosed herein.
Figure 25:
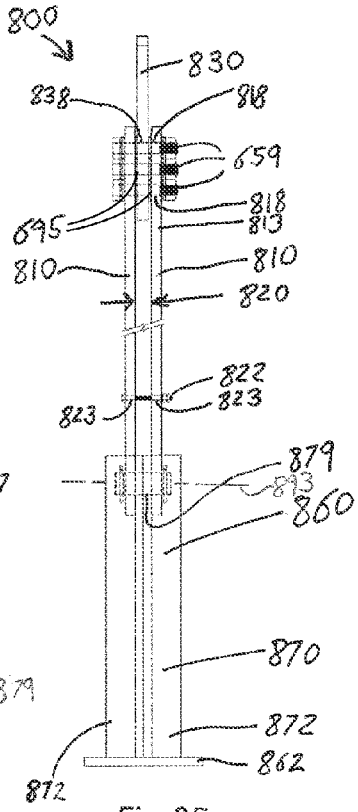
FIG. 25 is a side elevation view of the anchor rod assembly of FIG. 24.

FIG. 24 and FIG. 25 illustrate an anchor rod assembly 800 embodiment compatible as a replacement for anchor rod assembly 600 in anchor assembly 525 and method 700, which were previously described. Thus, various embodiments of anchor assembly 525 and various embodiments of method 700 include anchor rod assembly 800 instead of anchor rod assembly 600. Anchor rod assembly 800 includes an anchor linkage or anchor rod 805 configured to couple the anchor block 530 (FIG. 14) to an object to be stabilized, for example tower 10 of FIG. 1. Anchor rod assembly 800 further includes a mooring member 860 and a rotatable coupling 890.

Referring still to FIG. 24 and FIG. 25, anchor rod 805 includes a longitudinal axis 806, a plurality of axially-aligned, elongate anchor shafts 810, and an anchor head, which in this embodiment is a connector plate 830. In the example, anchor rod 805 is a generally rigid assembly having two anchor shafts 810.

Best shown in FIG. 25, each anchor shaft 810 is rectangular in cross-section and is similar to anchor shaft 610 (FIG. 17), having many similar features, such as, a through-hole 817 at a first end 812 and a plurality of through-holes 818 at a second end 813. Three through-holes 818 aligned with axis 806 are shown at second end 813, but other embodiments may have one, two, or any practical number of through-holes 818 in the same or any suitable pattern. Best shown in FIG. 25, the two anchor shafts 810 are spaced apart by a gap 820 and are held adjacent one another by a fastener 822 received within a hole 823 in each shaft 810. In some instances, the two anchor shafts 810 are pre-assembled using the fastener 822 in order to facilitate other steps of forming or installing anchor assembly 525. Connector plate 830 is similar to connector plate 630 (FIG. 17), comprising, for example, a first end 832, a second end 833 opposite first end 832, a plurality of aligned through-holes 838 at first end 832, and a plurality of through-holes 839 at second end 833. Each through-hole 839 is suited to couple a guy cable, a turnbuckle, or another object. Unlike anchor rod 605, connector plate 830 of anchor rod 805 couples between the two anchor shafts 810 without the aid of any splicing member 650. The pair of two anchor shafts 810 couple around the connector plate 830 by a plurality of fasteners 659, such as bolts held by lock washers and nuts for example, passing through concentric sets of the holes 818, 838. In anchor rod assembly 800, gap 820 between the anchor shafts 810 receives connector plate 830 and rotatably receives mooring member 860.

Figure 26:
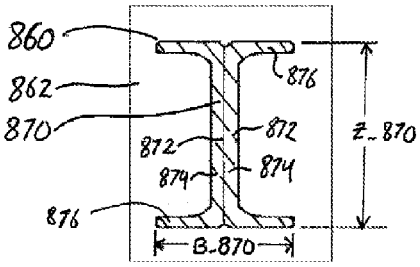
FIG. 26 shows a sectional top view of the mooring member of FIG. 24 as viewed from sectional plane B-B.

Referring again to FIG. 24 and FIG. 25, mooring member 860 includes a base plate 862 and an elongate body 870 extending from base plate 862. Body 870 comprises two channel members 872. Channel members 872 are similar to channel members 672 of mooring member 860. For example, as more clearly seen in FIG. 26, which is a sectional view B-B of FIG. 24, channel members 872 are three-sided, each comprising a central web member 874 and two flanges 876 forming right angles at the elongate edge of central web 874. Body 870 is characterized by a breadth B_870, defined to extend in the direction of flanges 876, and is characterized by a depth Z_870, defined to extend in the direction of webs 874. Referring to both FIG. 26 and FIG. 16, body breadth B_870 is sufficiently less than channel breadth B_565, and body depth Z_870 is sufficiently less than channel depth Z_565 to allow channel 565 to receive slidingly mooring member body 870. In addition, the lateral breadth and traverse depth of mooring member base plate 662 are larger than channel breadth B_565 and channel depth Z_565, respectively, so that base plate 662 cannot enter channel 565 when base plate 662 is parallel to lower surface 542 of anchor block 530. As indicated in FIG. 24, a 45° bevel 877 is cut on the inside of each flange 876 at the upper end, distal the base plate 862, to provide extra space or to provide a seat area for anchor rod 805 when it rotates.

Referring now to FIG. 25, unlike mooring member 660, the webs member 874 of channel members 872 are located immediately adjacent each other, i.e. contacting each other, and are not spaced-apart by a gap. In other embodiments, body 870 is formed from a single piece of I-beam or from a similar fabrication in place of the two channel members 872. Reference still to FIG. 25, an aperture 879 passes through the upper end of central web 874 on both channel members 872 at a height of H_879 from the top of base plate 862. In at least some embodiments, aperture height of H_879 above base plate 862 is less than the height H_530 of anchor block 530 (FIG. 15). Mooring member 860 may be formed as a weldment by welding together two or more separate pieces that comprise base plate 862 and body 870. Or, mooring member 860 may be formed by casting a single piece defining base plate 862 and body 870, by machining, or by any other suitable technique.

Rotatable coupling 890 includes a pin or cylindrical shaft 892 having a central axis 983 and extending through the concentrically aligned aperture 879 in mooring member body 670 and holes 817 of anchor shafts 810. Pin 892 is similar to pin 692 of FIG. 18, having similar features and being made of similar material. Pin 892 extends beyond mooring member body 870 and beyond the plurality of anchor shafts 810 anchor rod 805. A cotter key 698 is positioned in a through-hole at each end of pin 892 and positioned outside or on opposite sides of the plurality of anchor shafts 810. The two cotter keys 698 maintain the relative positions of anchor rod 805, member 860, and pin 892 relative to pin axis 893. The rotatable coupling 890 allows relative rotation of the anchor rod 805 with respect to the mooring member 860 and the anchor block 530 (e.g. FIG. 13). Anchor shaft 810 is rotatable about pin axis 893, capable of rotating within a geometric plane parallel to webs 874. Because aperture height of H_879 from base plate 862 is less than the height H_530 of anchor block 530 (FIG. 15) in at least this embodiment, the rotatable coupling 890, including pin 892 is positioned totally or at least partially within channel 565, adjacent or below upper surface 541 of anchor block 530 in the embodiment of anchor assembly 525. In some other embodiments, rod 890 is located completely outside the through-channel 565 of the anchor of the anchor block 530 and beyond upper surface 541.

The material selection for the various members of anchor rod assembly 800, including rotatable coupling 890, may be similar to the possible materials and combination of materials described for similar members of anchor rod assembly 600. In the example of FIG. 25, a plurality of electrical insulating members 695 are installed to separate the anchor shafts 810 from connector plate 830 and fasteners 659. Some embodiments do not include electrical insulating members 695.

Figure 27:
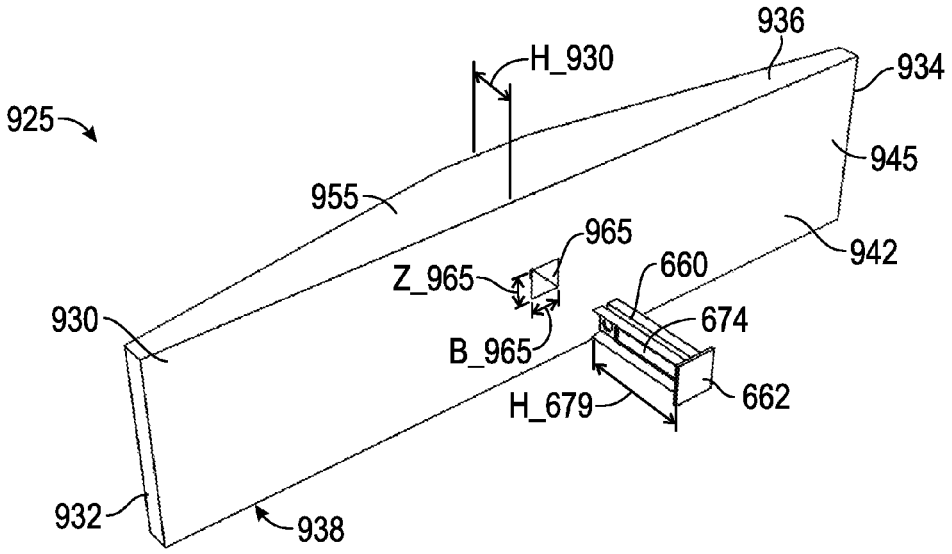
FIG. 27 is perspective view of the bottom of an anchor assembly during an exemplary stage of installation in accordance with the principles disclosed herein.
Figure 28:
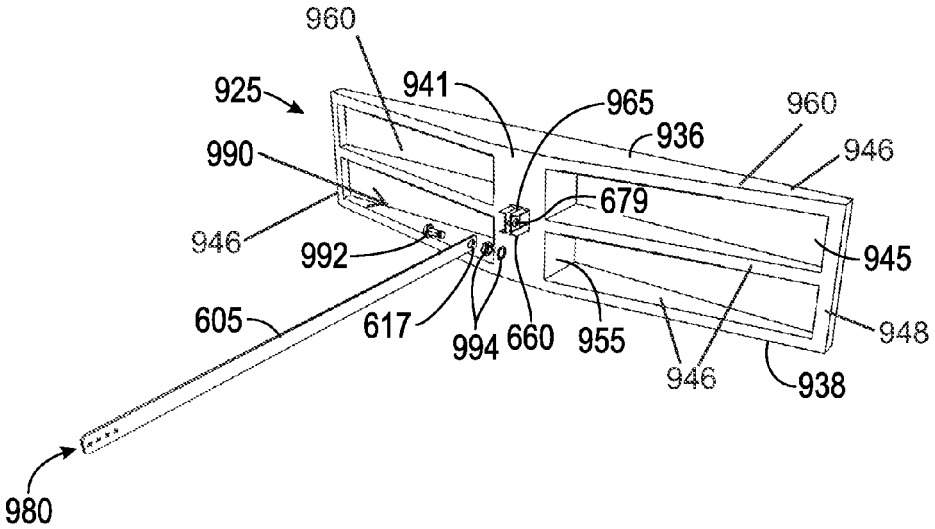
FIG. 28 is a perspective view of the top of the anchor assembly of FIG. 27 during another exemplary stage of installation in accordance with the principles disclosed herein.

FIG. 27 and FIG. 28 show another embodiment of an anchor assembly being prepared to couple anchored tower 10 of FIG. 1 or another object to be stabilized against movement. Anchor assembly 925 includes a pre-fabricated anchor block 930 and an anchor rod assembly 980. Anchor assembly 925 may also be called anchor 925. Some steps or operations of method 400 or some embodiments of method 700 apply to the installation of anchor assembly 925. Anchor assembly 925 is suitable for above-ground, subterranean, or marine installation.

Pre-fabricated anchor block 930 is similar to pre-fabricated anchor block 530 (FIG. 14 and FIG. 15) having many of the same features and characteristics. For example, anchor block 930 includes a base portion or base plate 945 extending laterally from a first side 932 to a second side 934 and extending in a perpendicular, i.e. transverse, direction from a first end 936 to a second end 938. Anchor block 930 further includes a body portion 955 coupled to the base portion 945 and extending between the first end 936 and the second end 938 and a plurality of sloping, laterally-extending structural ribs 946 and a plurality of transversely-extending structural ribs 948 coupled to the body portion 955 or the base portion 945. A plurality of recess is formed between ribs 946, 948. The outer surfaces of anchor block 930 include an upper surface 941 and a lower surface 942. Various embodiments of anchor block 930 include more or fewer of the features or characteristics of the multiple embodiments of anchor block 530; some shared the features and characteristics are shown in FIG. 27 and FIG. 28 while others may not be visible.

Anchor block 930 can be described as having a pair of wing portions 960 extending from either side of the body portion 955. The wing portions may be defined to include any of: the sloping ribs 946 that extend laterally from body portion 955, the lateral ribs 948, the base portion 945, and the recesses 52 disposed between the ribs 946.

However, distinct from anchor block 530, the pre-fabricated anchor block 930 includes a through-channel 965 having a rectangular cross-section in place of the I-shaped through-channel 565. The rectangular through-channel 965 is characterized by a lateral breadth B_965, a transverse depth Z_965, and a height equal to a height H_930 of anchor block 930. Channel 965 extends entirely through the base portion 945 and the body portion 955. Through-Channel 965 is configured to couple an anchor rod assembly to anchor block 930. In the example shown, through-channel 965 is square in cross-section and is centrally-positioned in body portion 955.

Anchor rod assembly 980 includes an anchor rod 605, a mooring member 660, and a rotatable coupling 990 between anchor rod 605 and mooring member 660. Anchor rod 605 and mooring member 660 were described previously in reference to FIG. 17 to FIG. 19, for example.

Referring now to FIG. 28, rotatable coupling 990 includes a cylindrical shaft 992 configured to extend through the hole 617 of anchor rod 605 and aperture 679 of mooring member 660. When installed, shaft 992 extends beyond anchor rod 605 and both webs 674 of mooring member body 670. Shaft 992 is configured as a threaded bolt that receives two opposing lock nuts that can be advantageously positioned along the bolt 992 (i.e. shaft 992) to maintain the relative positions of anchor rod 605, member 660, and shaft 992 while allowing the relative rotation of these members about the center of aperture 679 above 679.

The material selection for the various members of anchor rod assembly 980, including rotatable coupling 990, may be similar to the possible materials and combination of materials described for an anchor rod assembly 600, 800. Although not shown in FIG. 28, a plurality of electrical insulating members 695 may be included as members anchor rod 605 as previously described with respect to FIG. 18.

Referring again to both FIG. 27 and FIG. 28, for anchor assembly 925, the height of H_679 of aperture 679 above mooring member base plate 662 is greater than the height H_930 of anchor block 930, which is another differentiation from anchor block 530. Thus, when anchor assembly 925 is completed, the rotatable coupling 990 is positioned outside channel 565 and beyond the upper surface 941 of anchor block 930. Mooring member base plate 662 is configured to remain adjacent the lower surface 942, being too large laterally or too large transversely to enter channel 965.

FIG. 27 and FIG. 28 present another example of step 706, which involves coupling an anchor rod to the pre-fabricated anchor block. In FIG. 27, mooring member 660 is adjacent base portion 945 and aligned with channel 965 of anchor block 930. During assembly, member 660 is slidingly received by channel 965, starting at lower surface 942 and being completed when mooring member base plate 662 is adjacent the lower surface 942 of block 930. In FIG. 28, mooring member 660 has been fully seated in channel 965 so that aperture 679 is located beyond the upper surface 941. Anchor rod 605, bolt 992, and lock nuts 994 are being prepared to couple mooring member 660 at aperture 679 to complete the rotatable coupling 990, which remains outside channel 965. Other operations may be performed, such as for example, step 708 of method 700, which includes installing the pre-fabricated anchor block at the installation site.

Some embodiments of anchor rod assembly 980 and anchor assembly 925 include a rotatable coupling 690 (FIG. 18) positioned above (i.e. outside), within, or partially within anchor block 930 in place of rotatable coupling 990. In some embodiments, anchor rod assembly 980 includes an anchor rod 805 having a plurality of anchor shafts 810 (FIG. 24) and includes a mooring member 860 (FIG. 24 to FIG. 26) in place of anchor rod 605 and mooring member 660. When mooring member 860 is included, the aperture 879 and the associated rotatable coupling 890, 990 may be positioned outside, within, or partially within anchor block 930. Some embodiments of an anchor assembly include a rotatable coupling 990 having bolt 992 and lock nuts 994 positioned at least partially within a channel 565 of anchor block 530 or within channel 965 of anchor block 930.

Any of the anchor blocks, e.g. anchor blocks 30, 230, 530, 930, may comprise Portland cement, polymer-enhanced cement, concrete, metal, reinforced pre-cast concrete, pre-tensioned or post-tensioned pre-cast concrete, or another corrosion resistant material. In other embodiments, an anchor block 30, 230, 530, 930 comprises fiberglass, graphite-reinforced composite material, glass-reinforced plastic, or another polymeric material, which may make the anchor block relatively light-weight, compared to Portland cement, for example. In addition, some embodiments, one or more of the following features are embedded with structurally-reinforcing material: the structural ribs, the base portion, or a body portion. In some of these, structurally-reinforcing material surrounds a multi-facetted locking channels 65, 265 or a through-channel 565, 965. The structurally-reinforcing material, which may also be called structurally-reinforcing members, may be, for example, rods or fibers.

As shown in the various figures, anchor blocks 30, 230, 530, 930 are formed from substantially solid material. However, in some embodiments, a base portion, a body portion, or a structural rib may be perforated with a plurality of holes or may be imbedded with closed or open pores to reduce the weight-to-size ratio of the anchor block or in some instances to improve the integration of the anchor block with the natural surroundings in which it is placed. Furthermore, in some embodiments, the recesses between the structural ribs are filled with material.

Although, anchor blocks 30, 230, 530, 930 were presented as having a generally trapezoidal profile in a view (e.g. the views shown in FIG. 5 and FIG. 15), in some embodiments, the heights of structural ribs like ribs 46, 48, 546, 548 do not taper but remain at a constant height (e.g. The ribs may be rectangular in an end view such as FIGS. 5 and 15.), or the ribs vary in another manner (e.g. The ribs are not rectangular and are not triangular when viewed in a side view.). So too, the thickness of the structural ribs may vary. In some embodiments of an anchor block (e.g. anchor block 30, 230, 530) made according to this disclosure, the base portion, the body portion, and the structural ribs may be formed as a single piece or may be formed from multiple separate pieces and coupled together by any manner known in the art. The base portion, the body portion, and the structural ribs may be formed from the same material or materials or from different materials.

Although anchor blocks 30, 230, 530, 930 have been shown with the base portion extending in a perpendicular direction from the bottom of the body portion, and the ribs have been shown above the base portion, in various embodiments the arrangement is different. For example, the base portion may intersect the middle or the top of the body portion, and the ribs may be located below the base plate or may be locate both above and below the base plate. In some embodiments, the base portion slopes downward or upward with respect to the body portion.

Referring again to FIG. 4, in at least one embodiment, the magnitude of edge offset W_46 is nearly zero or equal to zero, making the width of central block 55, 255 nearly equal or equal to base portion width W_30. Although, FIG. 4 and FIG. 11 and may be interpretted to illustrate that length L_30 of anchor block 30, 230 is greater than width W_30 in at least one embodiment of anchor block 30, 230. In some others, the magnitude of width W_30 is greater than length L_30. In some embodiments of anchor block 30, 230, the orientation of multi-facetted locking channel 65, 265, respectively, may be rotated. Consequently, the orientation of anchor rod 150 would be rotated with respect to anchor block 30, 230. Similar variations are possible for anchor block 530, 930 and anchor rods assemblies 600, 800, 980.

Additional variations to the shape and dimensions of multi-facetted locking channel 65, 265 are possible. In addition to locking channel 65, 265 or in place of locking channel 65, 265, other means of connection may be included on an anchor block like block 30, 230. For example, an attachment loop (not shown) or a horizontal tie-down rod with a recess beneath the loop or rod (not shown) may be disposed near upper surface 41, 256 forming, at least in some instances, a coupling-channel. In at least one embodiment, a pre-fabricated anchor block has at least one locking channel 65 and at least one locking channel 265, blending the features of the anchor blocks 30, 230. In place of anchor rod 150, a rope, cable or other flexible member may couple between block 30, 230 and the tower 10 or between block 30 and another structure, such as a tent for gathering people for example. In at least one embodiment, second end 152 of anchor rod 150 couples more directly to tower 10 or another structure without an intervening guy cable 12. The embodiment(s) may include a modification to second end 152 resulting in a modified anchor rod. When an anchor block 30, 230 is disposed within earth 14 as previously described, a coupled combination of block 30, 230, anchor rod 150 (or modified anchor rod), and tower 10 may thereby be anchored, secured, or coupled to earth 14.

Still additional embodiments are contemplated and share characteristics of one or more of these previously-described embodiments. For example, an anchor block having an I-shaped through-channel 565 (e.g. FIG. 14) may also may include an edge offset of W_46 for the outermost lateral ribs 546. As another example, an anchor block having a multi-facetted locking channel 65 (e.g. FIG. 4 and FIG. 11) may be formed with various features similar to anchor block 525 (e.g. FIG. 14). The same sharing of some features is possible for anchor rods 150, 605, 805 (e.g. FIG. 9, FIG. 17, FIG. 24). For example a derivation of anchor rod 150 may be formed using a separate connector plate 630 coupled with a splice plate 650 (FIG. 17) in place of a connector plate 175 welded to shaft 155. In some embodiments, anchor blocks have only lateral structural ribs (e.g. ribs 46, 546) and not transverse structural rib (e.g. ribs 48, 548).

Referring to FIG. 9, FIG. 17, and FIG. 24 as examples, some embodiments of an anchor assembly include electrical insulation or electrical insulating members (e.g. members 695) in and around the through-holes (e.g. holes 184, 639, 839) in the connector plate (e.g. plates 175, 630, 830) of the anchor rod (e.g. anchor rods 150, 605, 805). Such electrical insulation may reduce or eliminate the potential for corrosion that could occur when dissimilar metals contact each other, as might otherwise occur in some embodiments due to the contact between a guy cable or a turnbuckle and the connector plate formed from a different metal. The electrical insulation may also reduce or eliminate the potential for a lightning strike to travel from a guy cable or a turnbuckle to the anchor assembly.

Some embodiments of an anchor assembly include an anchor block similar to anchor block 930 of anchor assembly 925 (FIG. 28) but having a round through-hole in place of the rectangular through-hole 965 and also include a mooring member body that is round in cross-section rather than having an I-shape as does the body of mooring member 660. Such embodiments allow the anchor rod assembly, including the mooring member, to rotate with respect to the anchor block, providing additional degree of freedom for motion and potentially reducing stress between the anchor rod assembly and the anchor block While discussions of various embodiments herein have involved embedding a pre-fabricated anchor block within a hole in the earth and covering the anchor block with fill material, the anchor blocks and anchor assemblies described herein are equally suited for above-ground or uncovered installations or for marine installations covered or uncovered by fill material.

While exemplary embodiments have been shown and described, modifications thereof can be made by one of ordinary skill in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. The inclusion of any particular method step or operation within the written description or a figure does not necessarily indicate that the particular step is necessary to the method. Unless expressly stated otherwise, the steps listed in a description of a method or in a method claim may be performed in any advantageous order, and in some implementations two or more of the method steps may be performed in parallel, rather than serially.

What is claimed is:

1. An anchor for stabilizing an object, the anchor comprising:

an anchor block comprising:

a base surface extending in a first direction between a first side of the block and a second side of the block and extending in a second direction between a first end of the block and a second end of the block, wherein the second direction is perpendicular to the first direction;

an upper surface spaced-apart from and disposed opposite the base surface;

a body portion having a centerline axis extending in the second direction through the first side and the second side, the body portion extending between the base surface and the upper surface in a third direction normal to the first direction and to the second direction;

a pair of wings, each of the pair of wings tapering to a thinner dimension as the wings extend from the body portion in the first direction; and a coupling-channel disposed in the body portion and extending through the upper surface, the coupling-channel configured to couple the anchor block to an anchor rod;

a mooring member having a body disposed in the coupling-channel extending in the third direction towards the upper surface of the anchor block; and an anchor rod rotatably coupled to the mooring member and extending beyond the upper surface, the anchor rod being configured to extend at least in the third direction;

a first hole in the mooring member;

a second hole in the anchor rod aligned with the first hole; and an elongate pin having a central axis and two ends separated along the central axis, the pin extending through the first and second holes along the central axis.

2. The anchor of claim 1 wherein the wings include a first plurality of spaced-apart, sloping ribs that taper to a thinner dimension as the sloping ribs extend from the body portion in the first direction:

wherein the wings include a plurality of recesses disposed between the sloping ribs, each recess being bound by a pair of adjacent, sloping ribs; and wherein the wings further include a base portion intersecting the body portion and extending in the first direction along at least some part of the sloping ribs.

3. The anchor of claim 1 wherein the coupling-channel comprises a through-channel extending entirely through the body portion.

4. The anchor of claim 1 wherein the mooring member includes a base plate disposed adjacent the base surface of the anchor block and a body extending from the base plate and into the through-channel of the anchor block.

5. An anchor for stabilizing an object, the anchor comprising:

an anchor block comprising:

a base portion extending in a first direction from a first side to a second side and extending in a second direction from a first end to a second end, wherein the second direction is perpendicular to the first direction;

a body portion coupled to the base portion and disposed between the ends, the body portion extending in a third direction away from the base portion to an upper surface spaced-apart from the base portion;

a through-channel extending in the third direction entirely through the base portion, the body portion, and the upper surface;

a plurality of elongate ribs coupled to the body portion and the base portion and extending in length along the base portion; and a plurality of recesses disposed between the ribs, each recess having an open end extending along a majority of the length of the adjacent ribs, the open end facing in the third direction away from the base portion, and each recess having a closed end adjacent the base portion; and an anchor rod assembly comprising:

an anchor rod configured to couple the anchor block to the object to be stabilized;

a mooring member including a base plate proximal the base portion of the anchor block and including a body extending from the base plate within the through-channel in the third direction towards the upper surface of the anchor block; and a rotatable coupling that couples the anchor rod to the body of the mooring member so that the anchor rod extends beyond the upper surface of the anchor block;

wherein the anchor block is configured to hold stationary the anchor rod assembly when the anchor block is buried in the ground.

6. The anchor of claim 5 wherein the through-channel comprises a cross-section including the shape of a capital letter "i" with serifs.

7. The anchor of claim 5 wherein the base plate of the mooring member restrains the anchor block against passing entirely through the through-channel; and wherein the anchor rod extends, opposite the base plate of the mooring member.

8. The anchor of claim 5 wherein the plurality of structural ribs includes a first plurality of structural ribs extending along the base portion from the body portion toward the first side and a second plurality of structural ribs extending along the base from the body portion toward the second side.

9. An anchor for stabilizing an object, the anchor comprising:

an anchor block comprising:

a base portion extending in a first direction from a first side to a second side and extending in a second direction from a first end to a second end, wherein the second direction is perpendicular to the first direction;

a body portion coupled to the base portion and disposed between the ends, the body portion extending in a third direction away from the base portion to an upper surface spaced-apart from the base portion;

a through-channel extending in the third direction entirely through the base portion, the body portion, and the upper surface;

a plurality of elongate ribs coupled to the body portion and the base portion and extending in length along the base portion; and a plurality of recesses disposed between the ribs, each recess having an open end extending along a majority of the length of the adjacent ribs, the open end facing in the third direction away from the base portion, and each recess having a closed end adjacent the base portion; and an anchor rod assembly comprising:

an anchor rod configured to couple the anchor block to the object to be stabilized;

a mooring member including a base plate proximal the base portion of the anchor block and including a body extending from the base plate within the through-channel in the third direction towards the upper surface of the anchor block; and a rotatable coupling that couples the anchor rod to the body of the mooring member so that the anchor rod extends beyond the upper surface of the anchor block, rotatable coupling comprising:

a first hole in the mooring member;

a second hole in the anchor rod aligned with the first hole; and an elongate pin having a central axis and two ends separated along the central axis, the pin extending through the first and second holes along the central axis.

10. The anchor of claim 9 wherein the pin is disposed adjacent the upper surface of the anchor block.

11. The anchor of claim 9 wherein the through-channel comprises two opposing channel walls;

wherein the pin is at least partially disposed within the through-channel with the pin ends each facing one of the two channel walls;

wherein a gap is disposed between at least the first of the pin ends and the channel wall that faces the first pin end, the gap allowing axial movement of the pin within the through-channel; and wherein the length of the pin is configured so that the pin remains engaged with the body of the mooring member and the anchor rod through the full range of axial movement within the through-channel permitted to the pin by the channel walls and the gap.

12. The anchor of claim 9 wherein the body of the mooring member comprises two channel members disposed adjacent one another and oriented back-to-back.

13. An anchor for stabilizing a tower, the anchor comprising:

an anchor block having:

a base surface extending in a first direction from a first side to a second side and extending in a second direction from a first end to a second end, wherein the second direction is perpendicular to the first direction;

an upper surface spaced-apart from and disposed opposite the base surface;

a coupling-channel extending from an exterior opening in the upper surface toward the base surface;

a body portion disposed between the base surface and the upper surface; and a pair of wings extending from the body portion in the first direction and tapering to a thinner dimension as the wings extend in the first direction;

wherein the coupling-channel extends entirely through the body portion, including the base surface;

a rigid mooring member slidingly disposed in the coupling-channel and coupled to the anchor block;

a pin member coupled to the mooring member; and a rigid elongate member having a first end pivotably coupled to the mooring member by the pin member and having a second end configured to couple to a guy cable extending from the tower;

wherein the rigid elongate member extends beyond the opening in the upper surface of the anchor block; and wherein the pin member is disposed proximal the upper surface and distal the base surface of the anchor block.

14. The anchor of claim 13 further comprising a connector plate having a narrow end coupled to the second end of the rigid elongate member, a wider end spaced apart from the narrow end, and a plurality of holes in the wider end.

15. The anchor of claim 13 wherein the wings include a first plurality of spaced-apart, sloping ribs, the sloping ribs tapering to a thinner dimension as the sloping ribs extend from the body portion in the second direction; and wherein the wings include a plurality of recesses disposed between the sloping ribs and defined by the sloping ribs, each recess having an open end facing away from the base surface and extending along a majority of the length of one of the adjacent ribs.

16. The anchor of claim 13 wherein the rigid elongate member further comprises a first hole in the first end;

wherein the mooring member comprises an elongate body with a second hole; and wherein the pin member extends through the first hole and the second hole.

17. The anchor of claim 13 wherein the mooring member comprises two channel members disposed adjacent one another and oriented back-to-back.

18. The anchor of claim 17 further comprising:

a second rigid elongate member parallel to the first rigid elongate member and having a first end pivotably coupled to the mooring member by the pin member and having a second end opposite the first end;

a connector plate having a narrow end coupled between the second ends of the first and second rigid elongate members, a wider end spaced apart from the narrow end, and a plurality of holes in the wider end;

a first hole extending through the first ends of the first and second rigid elongate members; and a second hole extending through the two channel members of the mooring member;

wherein the pin member extends through the first hole and the second hole.

19. The anchor of claim 17 wherein the mooring member further comprises a base plate attached to the two channel members;

wherein the anchor block includes:

a body portion having a first surface and having a second surface opposite the first surface; and wherein the coupling-channel extends entirely through the body portion, including the base surface, and slidingly receives the mooring member; and wherein the base plate of the mooring member is disposed adjacent the base surface.

20. The anchor of claim 13 wherein the mooring member comprises two channel members that are spaced apart, forming a gap therebetween;

wherein the two channel members are attached to a base plate; and wherein the pin and the first end of the rigid elongate member are disposed in the gap.

21. The anchor of claim 20 further comprising a connector plate having a narrow end coupled to the second end of the rigid elongate member, a wider end spaced apart from the narrow end, and a plurality of holes in the wider end;

wherein the rigid elongate member further comprises a first hole in the first end;

wherein the mooring member further comprises a second hole extending through the two channel members; and wherein the pin member extends through the first hole and the second hole;

wherein the opening in the upper surface of the anchor block is disposed at a location equally displaced from the first and second sides and equally displaced from the first and second ends.

22. The anchor of claim 13 wherein the mooring member comprises two rigid members disposed adjacent one another within the coupling-channel;

wherein the mooring member further comprises a hole extending through the two rigid members; and wherein the pin member extends through the hole.

* * * * *